US008146847B2

(12) United States Patent
Wakamatsu et al.

(10) Patent No.: US 8,146,847 B2
(45) Date of Patent: Apr. 3, 2012

(54) POWDER BASED GRANULES DISINTEGRATING AND SIZING DEVICE, AND POWDER BASED GRANULES DISINTEGRATING AND SIZING METHOD

(75) Inventors: Yoshihiro Wakamatsu, Hokkaido (JP); Azusa Ichiki, Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 327 days.

(21) Appl. No.: 12/085,036

(22) PCT Filed: Dec. 12, 2006

(86) PCT No.: PCT/JP2006/325148

§ 371 (c)(1),
(2), (4) Date: May 15, 2008

(87) PCT Pub. No.: WO2007/069764

PCT Pub. Date: Jun. 21, 2007

(65) Prior Publication Data

US 2009/0108112 A1 Apr. 30, 2009

(30) Foreign Application Priority Data

Dec. 14, 2005 (JP) ..... 2005-359770

(51) Int. Cl.
*B02C 7/11* (2006.01)

(52) U.S. Cl. ..... 241/188.2; 241/297

(58) Field of Classification Search ..... 241/261.2, 241/65, 86, 89.3, 189.1, 297, 188.1, 188.2, 241/13

See application file for complete search history.

(56) References Cited

U.S. PATENT DOCUMENTS

| | | | | |
|---|---|---|---|---|
| 1,526,077 | A * | 2/1925 | Molz | 241/45 |
| 2,013,800 | A * | 9/1935 | Daniels | 241/56 |
| 3,662,961 | A * | 5/1972 | Walkowiak | 241/56 |
| 4,036,443 | A * | 7/1977 | Saltarelli | 241/297 |
| 4,081,147 | A * | 3/1978 | Seifert et al. | 241/261.3 |

(Continued)

FOREIGN PATENT DOCUMENTS

JP S53-71866 6/1978

(Continued)

OTHER PUBLICATIONS

International Search Report issued on Mar. 13, 2007 in connection with corresponding PCT application No. PCT/JP2006/325148 filed Dec. 12, 2006.

*Primary Examiner* — Faye Francis
(74) *Attorney, Agent, or Firm* — Posz Law Group, PLC

(57) ABSTRACT

A powder based granules disintegrating and sizing device, includes: a drive shaft that is inserted horizontally in the casing main body; a plurality of circular plates that are fixedly supported at intervals by the drive shaft; and a stator, the plate surface of the circular plate and the inclined surface of the stator configuring a gap portion A where a powder based granules accumulates, and a narrowest gap portion between the circumferential edge of the circular plate and the stator configuring a disintegrating and sizing portion B. The stator stretches over the entire circumference of the circular plate, a raw material feeding port is provided on a side wall in the vicinity of the drive shaft of the casing main body, and a cutout portion through which a raw material passes is formed on the plate surface of the circular plate.

19 Claims, 13 Drawing Sheets

U.S. PATENT DOCUMENTS 4,171,101 A * 10/1979 Seifert et al. ..... 241/30
4,214,716 A * 7/1980 Jadouin ..... 241/185.5
4,614,309 A * 9/1986 Goldenberg ..... 241/163
4,619,414 A * 10/1986 Kirchner et al. ..... 241/261.3
4,783,014 A * 11/1988 Fredriksson et al. ..... 241/261.2
4,819,881 A * 4/1989 Sepke ..... 241/88.1
5,707,019 A * 1/1998 Aikawa ..... 241/261.2
5,762,275 A * 6/1998 Aikawa ..... 241/261.2
7,128,286 B2 * 10/2006 Chaney et al. ..... 241/247
RE39,688 E * 6/2007 LaRiviere ..... 241/46.01
2006/0124788 A1 6/2006 Nara et al.

FOREIGN PATENT DOCUMENTS

JP S61-39198 3/1986
JP 8-038920 A 2/1996
JP 2000-103658 4/2000
JP 2000-117131 4/2000

* cited by examiner

POWDER BASED GRANULES DISINTEGRATING AND SIZING DEVICE, AND POWDER BASED GRANULES DISINTEGRATING AND SIZING METHOD

CROSS REFERENCE TO RELATED APPLICATIONS

This application is a U.S. national stage application of PCT/JP2006/325148 filed on Dec. 12, 2006, and claims priority to, and incorporates by reference, Japanese Patent Application No. 2005-359770, filed on Dec. 14, 2005.

TECHNICAL FIELD

The present invention relates to a powder based granules disintegrating and sizing device and a powder based granules disintegrating and sizing method for sizing a variety of wet or dried materials, such as drugs, foods, fodder, chemicals, fertilizers, fine coals, limestone and ceramic materials that are granulated or molded by various devices, into a predetermined grain size, and more specifically relates to a powder based granules disintegrating and sizing device and a powder based granules disintegrating and sizing method for disintegrating wet agglomerated substances, dried block substances, or other granulated substances (lumps) of at least a target grain size that are granulated or molded by various devices, and then adjusting the grain size thereof within a predetermined grain size range.

BACKGROUND ART

Nowadays, in a wide range of fields, including the fields of medical and food products, the operations of mixing, granulating and sizing powdery granular bodies are performed. The grain size adjustment work that is performed in a product production process is one of the important unit operations for improving fluidization of a fluidized drying process and improving the handling process.

Here, in a conventionally-used powder based granules disintegrating and sizing device, granular size control was performed using a screen. Therefore, there was a possibility that the screen would become worn and damaged by continuous use and that worn particles or damaged pieces of the screen are mixed into the produced powder based granules. Also, in the case of a wet material, depending on the property of the processed substance, the screen was clogged when the substance adhered thereto, and the processed substance was kneaded inside the screen. Furthermore, there was a disadvantage that grains of an appropriate grain size also were disintegrated by impact force of a granulating blade, whereby a large number of fine particles were generated, resulting in poor yields.

Therefore, the present applicant has first developed a powder based granules disintegrating and sizing device in which a screen is not used, and applied for a patent [see Japanese Published Unexamined Patent Application No. 2000-117131 ("Patent Literature 1" hereinafter) and WO 2004/085069A1 ("Patent Literature 2" hereinafter)].

This powder based granules disintegrating and sizing device is a powder based granules disintegrating and sizing device for sizing wet or dried material, which is supplied from a material feeding port, through a predetermined accumulation region, wherein: a rotating body and an opposed surface portion that faces the rotating body to have a predetermined space there between are provided to form a gap area within a casing main body configuring the device; the gap area is constituted to be a grain size adjusting area that allows particles fitting to the predetermined set gap to pass and does not allow passage of particles that are not fitting to the predetermined set gap; and the particles that cannot pass through the gap area are brought into contact with the opposed surface portion at an inlet or a surface area portion of the gap area in cooperation with the rotation of the rotating body and disintegrated so as to be able to pass through the gap area and then be discharged from a discharge port.

Here, the gap area is provided with the surface area portion or a line area portion, which sets the space between the rotating body and the opposed surface portion as a narrowest gap portion, and the narrowest gap portion is configured to disintegrate the particles in the vicinity thereof.

Specifically, in the powder based granules disintegrating and sizing device described in Patent Literature 1, the rotating body is formed into a substantially conical shape having a rotation shaft in a vertical direction, the casing main body is formed into a substantially hollow conical shape, the accumulation region of the powder based granules is configured by an inner wall of the casing main body and a circumferential surface of the rotating body, and the narrowest gap portion is configured by a lower end circumferential edge of the rotating body and the inner wall of the casing main body.

Moreover, in the powder based granules disintegrating and sizing device described in Patent Literature 2, a casing main body has therein a horizontally fitted drive shaft, a plurality of circular plates fixedly supported at intervals by the drive shaft, and stators which are arranged so as to be opposed to plate surfaces at lower circumferential edge portions of the circular plates and each of which has an inclined surface that narrows a gap between adjacent plate surfaces toward circumferential edges of the plate surfaces, wherein the plate surfaces of the circular plates and the inclined surfaces of the stators form gap portions where a powder based granules accumulates, and wherein disintegrating and sizing portions are configured by narrowest gap portions formed between the circumferential edges of the circular plates and the stators.

However, in the powder based granules disintegrating and sizing device described in Patent Literature 1, the narrowest gap portion that is formed by the lower circumferential edge of the substantially conical rotating body and the inner wall of the casing main body is in the form of a single line forming a circle. For this reason, a large disintegrating and sizing area cannot be obtained, and thus there is a problem that the diameter of a lower part of the rotating body needs to be increased in order to obtain a large disintegrating and sizing area, which leads to an increase in the size of the device.

Also, in the powder based granules disintegrating and sizing device described in Patent Literature 2, because the stators are fitted only on the lower side of the circular plates, disintegrating and sizing actions are not performed on the upper side of the circular plates, which makes the device inefficient. Moreover, the powder based granules to be processed is supplied from the upper side of the circular plates, but it is difficult to allow the powder based granules to enter the upper side of the circular plates because the powder based granules is bounced by the centrifugal force of the circular plates. In addition, the problem when processing a highly wet material is that processed substances adhere to the disintegrating and sizing portions (narrowest gap portions), the vicinity of the feeding port, the vicinity of the discharge portion and the like, whereby stable operation cannot be performed.

DISCLOSURE OF THE INVENTION

The present invention was contrived in view of the problems that the above-described background has, and an object of the present invention is to provide a powder based granules disintegrating and sizing device, which is compact, capable of obtaining a sufficiently large disintegrating and sizing area, capable of preventing a powder based granules to be sized from adhering to an inner surface of the device even when the powder based granules is a highly wet material, capable of removing the powder based granules in the early stage even if it adheres to the inner surface of the device, and capable of being operated stable for a long time, and to also provide a powder based granules disintegrating and sizing method.

In order to achieve the object described above, the first powder based granules disintegrating and sizing device according to the present invention is a powder based granules disintegrating and sizing device having: a drive shaft that is inserted horizontally in the casing main body; a plurality of circular plates that are fixedly supported at intervals by the drive shaft; and a stator that is installed so as to be opposed to a plate surface at a circumferential edge portion of each of the circular plates and has an inclined surface that causes a gap between the plate surface of the circular plate and the stator to become narrower toward the circumferential edge of the circular plate, the plate surface of the circular plate and the inclined surface of the stator configuring a gap portion where a powder based granules accumulates, and a narrowest gap portion between the circumferential edge of the circular plate and the stator configuring a disintegrating and sizing portion, wherein the stator stretches over the entire circumference of the circular plate, a raw material feeding port is provided on a side wall in the vicinity of the drive shaft of the casing main body, and a cutout portion through which a raw material passes is formed on the plate surface of the circular plate.

Also, in order to achieve the object described above, the second powder based granules disintegrating and sizing device according to the present invention is a powder based granules disintegrating and sizing device having: a drive shaft that is inserted horizontally in the casing main body; a plurality of circular plates that are fixedly supported at intervals by the drive shaft; and a stator that is installed so as to be opposed to a plate surface at a circumferential edge portion of each of the circular plates and has an inclined surface that causes a gap between the plate surface of the circular plate and the stator to become narrower toward the circumferential edge of the circular plate, the plate surface of the circular plate and the inclined surface of the stator configuring a gap portion where a powder based granules accumulates, and a narrowest gap portion between the circumferential edge of the circular plate and the stator configuring a disintegrating and sizing portion, wherein the stator stretches over the entire circumference of the circular plate, and a raw material feeding port is provided on a side wall in the vicinity of the drive shaft of the casing main body and on a circumferential wall located between adjacent circular plates.

According to the first and second powder based granules disintegrating and sizing devices of the present invention, because the disintegrating and sizing portion is formed over the entire circumference of each circular plate and the powder based granules can be disintegrated and sized efficiently, the device can be further downsized. Moreover, because the powder based granules to be processed is fed to the vicinity of the center of each circular plate or between the circular plates and caused to flow out of the center in the direction of an outer circumference by the centrifugal force of the circular plates, the powder based granules can be supplied smoothly without colliding with processed substances that are scattered by the centrifugal force of the circular plates, hence adhesion of the powder based granules within the casing main body can be reduced and thereby the device can be driven stable for a long time.

Here, the second powder based granules disintegrating and sizing device according to the present invention described above may be configured such that an upper part of the casing main body is formed into a semi-cylindrical shape concentric with a shaft core of the drive shaft, that semi-ring hollow projections concentric with the upper part are provided in a direction of the shaft in a plurality of sections over the entire outer circumferential portion of the upper part, that the circular plates are fitted in the semi-ring hollow projections respectively, and that the raw material feeding port is provided on a circumferential wall between the semi-ring hollow projections.

According to the powder based granules disintegrating and sizing device of the present invention, the raw material feeding port between the circular plates can be open in the vicinity of the center of each circular plate, so that the raw material can be supplied smoothly.

Moreover, the first or second powder based granules disintegrating and sizing device according to the present invention described above may be configured such that an upper part of the casing main body is formed into a semi-cylindrical shape concentric with the drive shaft, and that a sheet-like member with a smooth surface is lined in at least a part of an inner circumferential surface of the semi-cylindrical upper part of the casing main body.

According to the powder based granules disintegrating and sizing device of the present invention, due to the presence of the lined sheet-like member having a smooth surface, adhesion of the powder based granules within the casing main body can be reduced, and thereby the device can be operated stable for a long time.

In addition, the present invention described above may be configured such that the sheet-like member is formed of a flexible material and that an impact is applied to the sheet-like member from the casing main body side by means of, for example, a pin cylinder or the like provided in the casing main body.

According to the powder based granules disintegrating and sizing device of the present invention, even if the powder based granules adheres within the casing main body, it can be brushed off forcibly in the early stage so that the adhered substances can be prevented from growing, whereby the device can be operated further stable for a long time.

The first or second powder based granules disintegrating and sizing device according to the present invention may be configured such that a gas supply pipe communicating with the raw material feeding port of the casing main body is provided and that a gas discharge path is connected to a discharge port that is provided in a lower part of the casing main body.

According to the powder based granules disintegrating and sizing device of the present invention, by blowing hot gas from the gas supply pipe into the casing main body, the powder based granules to be processed receives heat directly from the hot gas or indirectly from a surface of the device heated by the hot gas, and then moisture on a surface of the powder based granules evaporates (dries out), hence it is possible to prevent adhesion of the powder based granules to the inner surface of the device, which is caused by the moisture, and to operate the device stable for a longtime. Also, when cold gas is blown from the gas supply pipe into the casing main body, disintegrating and sizing processing can be performed even on a material having a low softening temperature, such as chocolate.

In addition, the first or second powder based granules disintegrating and sizing device according to the present invention may be configured such that a cutout portion is formed on a circumferential edge of the stator and that an adapter is fitted in the cutout portion.

According to the powder based granules disintegrating and sizing device of the present invention, a gap of the disintegrating and sizing portion can be adjusted easily by adjusting the thickness of the adapter. Note that, in this case, the adapter may be fitted in the cutout portion with a spacer therebetween.

Moreover, the first or second powder based granules disintegrating and sizing device according to the present invention may be configured such that projections are provided respectively on opposed surfaces of the circular plate and the stator that configure the disintegrating and sizing portion.

According to the powder based granules disintegrating and sizing device of the present invention, the projections can efficiently disintegrate the powder based granules even if the powder based granules is entirely formed of hard dried substances or has a hard core, and the disintegrating and sizing actions performed by the disintegrating and sizing portion to disintegrate and size the powder based granules can be further improved. Note that, in this case, in terms of disintegrating and sizing efficiency, the projection provided on each of the opposed surfaces is preferably fitted such that the projection provided on one of the opposed surfaces passes between the projections provided on the other opposed surface.

Furthermore, the first or second powder based granules disintegrating and sizing device of the present invention may be configured such that a disintegrating pin for roughly disintegrating the powder based granules is provided on the inclined surface of the stator and/or the plate surface of the circular plate.

According to the powder based granules disintegrating and sizing device of the present invention, even when the powder based granules accumulates between the plate surfaces of the circular plates, the powder based granules can be roughly disintegrated to assist in the disintegrating and sizing actions performed by the narrowest gap portion and the like.

The first or second powder based granules disintegrating and sizing device of the present invention may be configured such that an auxiliary pin for pressing the powder based granules toward the disintegrating and sizing portion is provided on the plate surface of the circular plate configuring the gap portion.

According to the powder based granules disintegrating and sizing device of the present invention, the auxiliary pin provided on the plate surface of the circular plate functions to push the powder based granules out toward the disintegrating and sizing portions so that the powder based granules does not accumulate easily and that throughput can be increased. Note that, in this case, the auxiliary pin provided on the plate surface of the circular plate has a substantially triangular shape in a plan view, and it is preferred in terms of the action of pushing out the powder based granules that one of the top points of the substantially triangular auxiliary pin] be directed in a rotation direction of the circular plate.

Also, in order to achieve the object described above, the first powder based granules disintegrating and sizing method according to the present invention uses the above-described first or second powder based granules disintegrating and sizing device of the present invention to disintegrate and size a powder based granules while heating and drying the same.

According to the first powder based granules disintegrating and sizing method of the present invention, because the powder based granules is disintegrated and sized while being heated and dried, adhesion of the powder based granules within the device can be prevented, and a step of drying the processed substances, which is performed subsequently, can be eliminated or simplified. Note that, in this case, the powder based granules can be heated and dried by supplying hot gas into the device or by disposing an electric heater or the like in an appropriate section within the device.

Here, the first powder based granules disintegrating and sizing method according to the present invention may be a method in which the first or second powder based granules disintegrating and sizing device according to the present invention is configured such that a gas supply pipe communicating with the raw material feeding port of the casing main body is provided and a gas discharge path is connected to a discharge port that is provided in a lower part of the casing main body, and in which hot gas is supplied from the gas supply pipe.

According to the powder based granules disintegrating and sizing method of the present invention, the powder based granules can be heated and dried by supplying hot gas, the flow of the hot gas from the raw material feeding port to the discharge port can be formed within the device, and the powder based granules can be caused to follow the flow of the hot gas and then be guided smoothly to the disintegrating and sizing portion, whereby the powder based granules can be disintegrated and sized efficiently.

Moreover, the present invention described above may be a method in which hot gas in an amount slightly larger than the amount of the hot gas supplied from the gas supply pipe is discharged from the gas discharge path.

According to the powder based granules disintegrating and sizing method of the present invention, the powder based granules is guided to the disintegrating and sizing portion more smoothly by the pressure balance between suction gas and discharge gas within the device, whereby the powder based granules can be disintegrated and sized more efficiently.

Moreover, in order to achieve the object described above, the second powder based granules disintegrating and sizing method according to the present invention uses the above-described first or second powder based granules disintegrating and sizing device of the present invention to disintegrate and size a powder based granules while cooling the same.

According to the second powder based granules disintegrating and sizing method of the present invention, because the powder based granules is disintegrated and sized while being cooled, disintegrating and sizing processing can be performed even on a material having a low softening temperature, such as chocolate, and adhesion of softened and melted substances within the device can also be prevented. Note that, in this case, the powder based granules can be cooled by supplying cold gas into the device or by disposing a cooling device or the like in an appropriate section within the device.

Here, the second powder based granules disintegrating and sizing method according to the present invention may be a method in which the first or second powder based granules disintegrating and sizing device of the present invention is configured such that a gas supply pipe communicating with the raw material feeding port of the casing main body is provided and a gas discharge path is connected to a discharge port that is provided in a lower part of the casing main body, and in which cold gas is supplied from the gas supply pipe.

According to the powder based granules disintegrating and sizing method of the present invention, the powder based granules can be cooled by supplying cold gas, the flow of the cold gas from the raw material feeding port to the discharge port can be formed within the device, and the powder based granules can be caused to follow the flow of the cold gas and then be guided smoothly to the disintegrating and sizing portion, whereby the powdery granular can be disintegrated and sized efficiently.

In addition, the present invention described above may be a method in which cold gas in an amount slightly larger than the amount of the cold gas supplied from the gas supply pipe is discharged from the gas discharge path.

According to the powder based granules disintegrating and sizing method of the present invention, the powder based granules is guided to the disintegrating and sizing portion more smoothly by the pressure balance between suction gas and discharge gas within the device, whereby the powder based granules can be disintegrated and sized more efficiently.

BEST MODE FOR CARRYING OUT THE INVENTION

Figure 1:
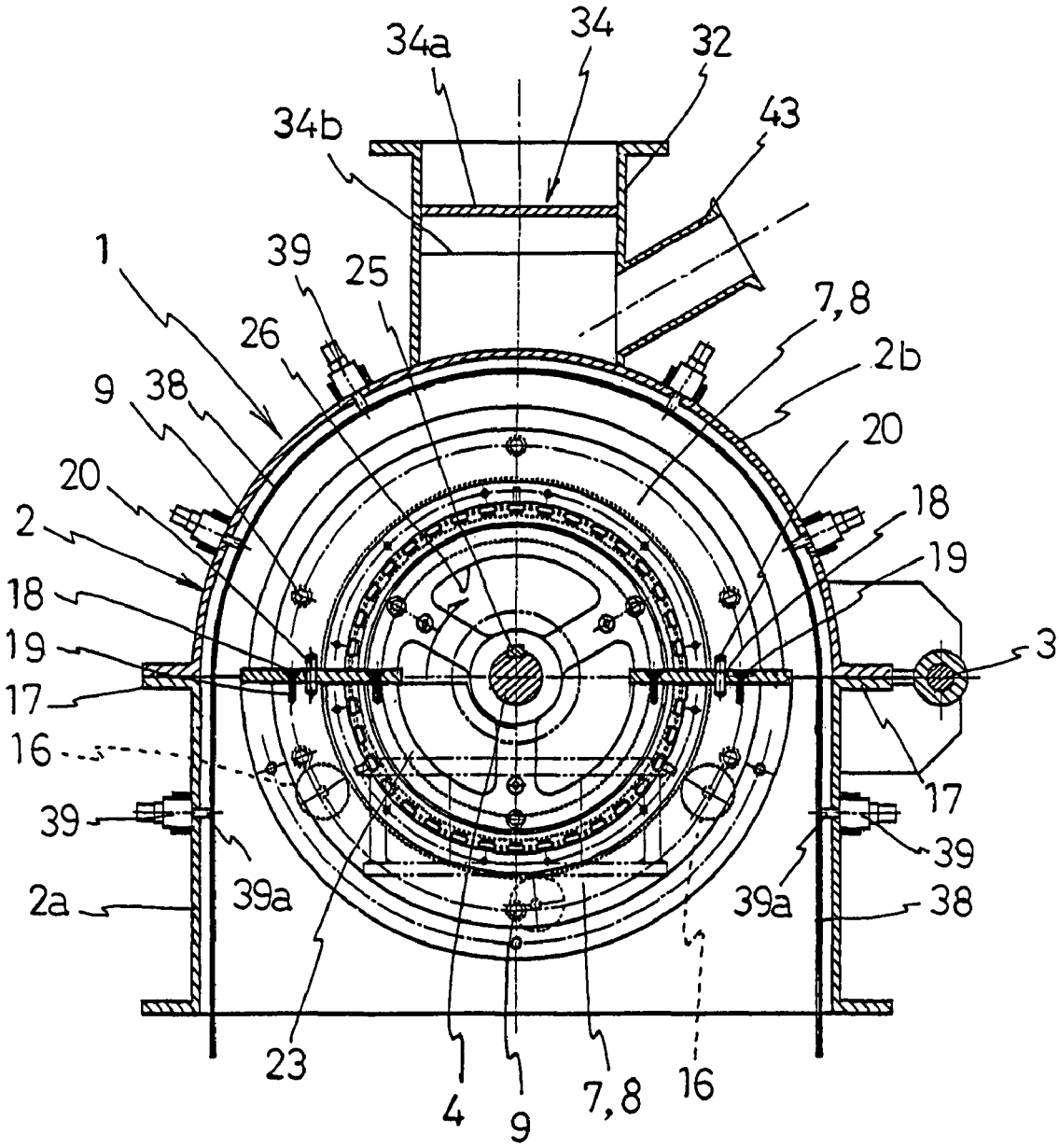
FIG. 1 is a longitudinal cross-sectional front view showing a first embodiment of the powder based granules disintegrating and sizing device according to the present invention.

Hereinafter, the powder based granules disintegrating and sizing device and the powder based granules disintegrating and sizing method according to the above-described present invention will be described in detail based on the embodiments shown in the drawings.

First, the powder based granules disintegrating and sizing device according to the present invention shown in FIG. 1 through FIG. 8 is described.

In a powder based granules disintegrating and sizing device 1 according to the first embodiment of the present invention shown in these drawings, a casing main body 2 is configured by a rectangular lower casing main body 2*a* and a semi-cylindrical upper casing main body 2*b*. A hinge 3 is provided on one side of the lower casing main body 2*a* and upper casing main body 2*b*, and the upper casing main body 2*b* is attached to an upper surface of the lower casing main body 2*a* so as to be openable/closable with respect to the hinge 3 as a point of support.

Figure 2:
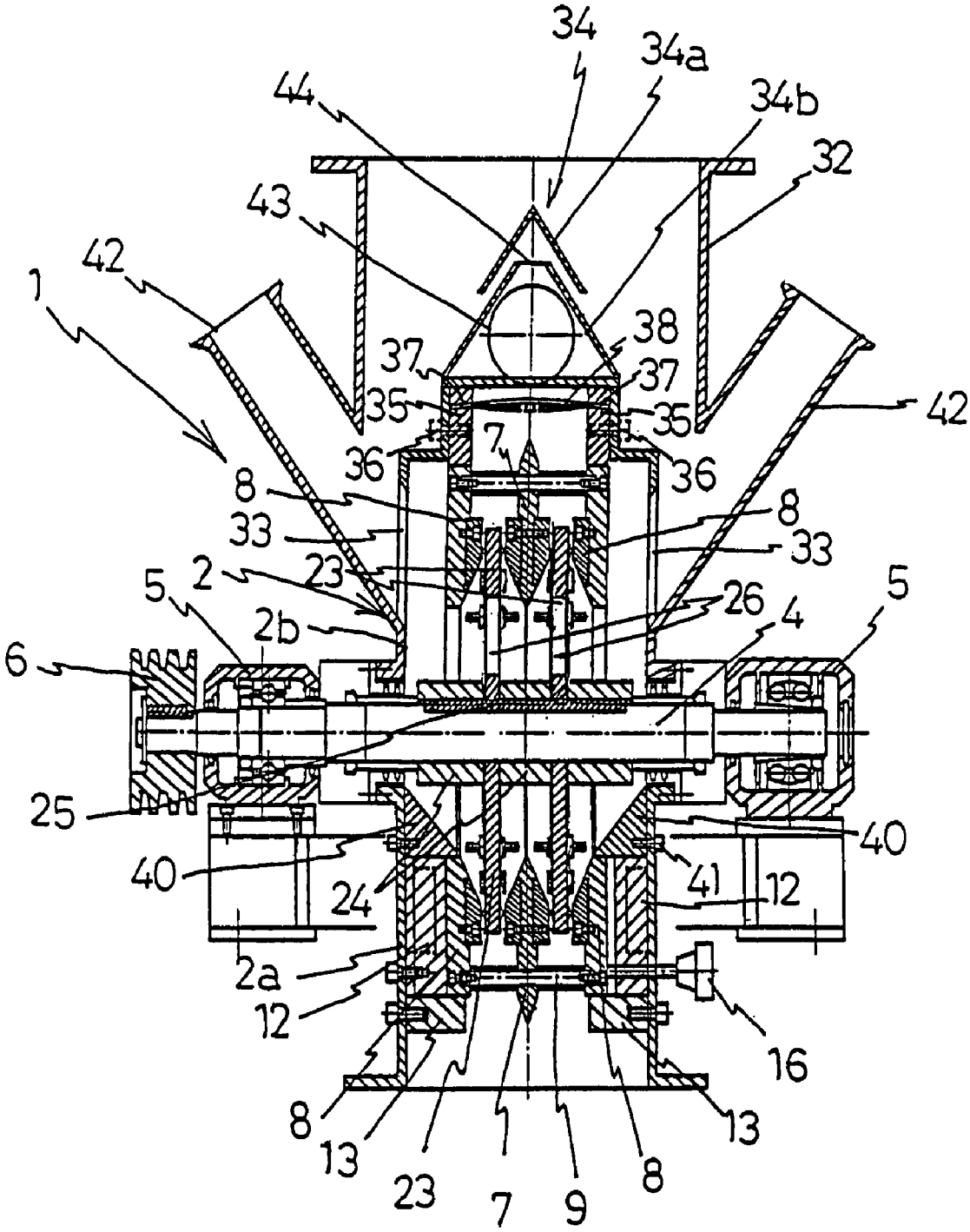
FIG. 2 is a longitudinal cross-sectional side view of this device.

A drive shaft 4 is inserted horizontally in the casing main body 2, and, as shown in FIG. 2, both ends of the drive shaft 4 stretch out through the casing main body 2 and are supported by shaft bearings 5, 5 respectively. In addition, one of the ends of the drive shaft 4 is provided with a pulley 6, and this pulley 6 is linked to a pulley of a motor via a belt, not shown.

Within the lower casing main body 2*a*, there are fitted one or a plurality of (there is one in the device according to the illustrated embodiment) semi-arc shaped stators 7 each having a substantially isosceles triangular cross-sectional shape and a pair of right and left semi-arc shaped stators 8, 8 each having a substantially right triangular cross-sectional shape and each having the same internal diameter as the stators 7, wherein the top portion of each of the stators 7 and 8 is directed to the drive shaft 4.

Figure 3:
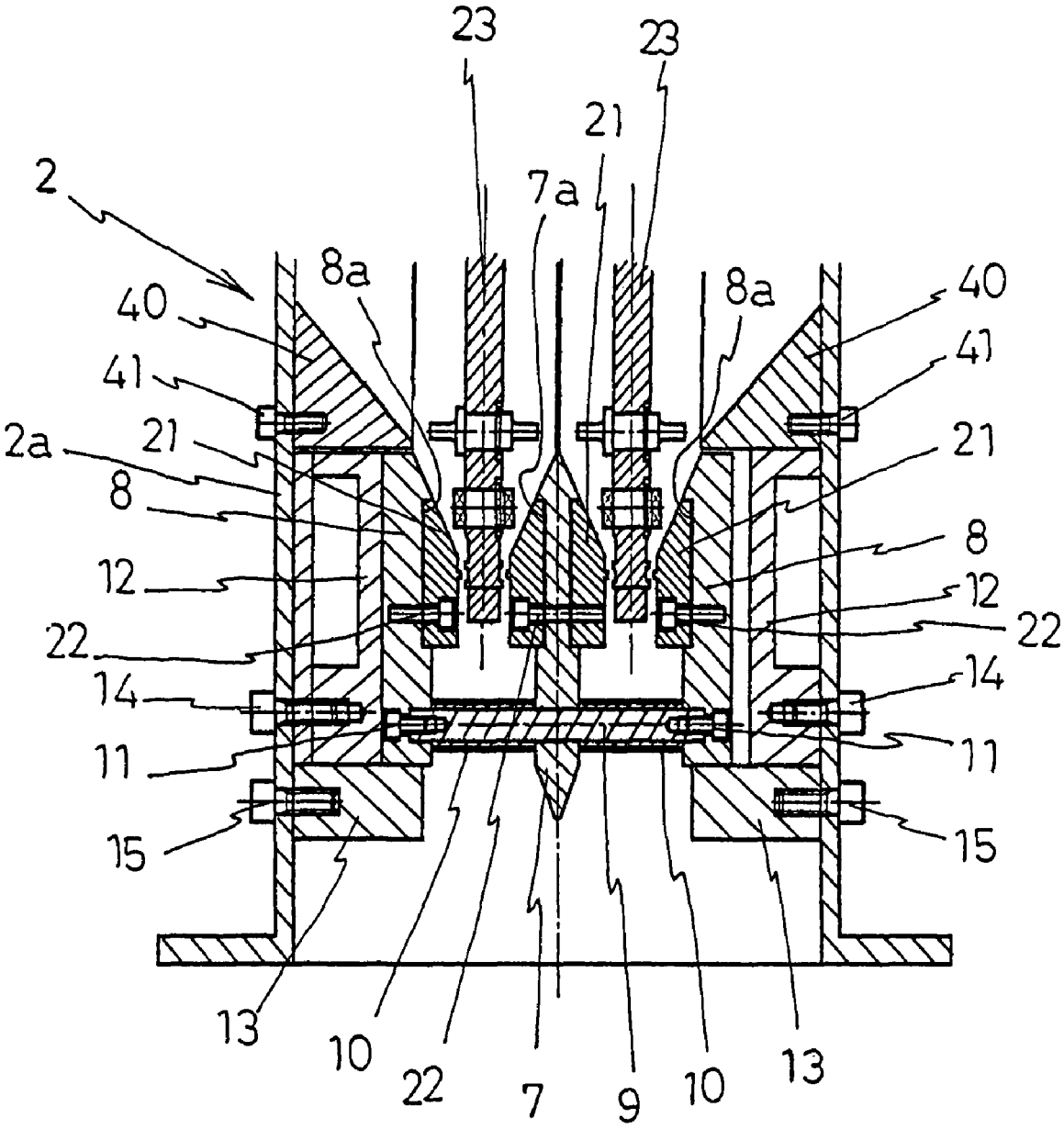
FIG. 3 is a cross-sectional view showing enlarged substantial parts of the device shown in FIG. 1 and FIG. 2.

A fixed axis 9 is inserted into each of a plurality of through-holes of the stators 7, 8 that are provided at equal distances in a radial direction and at equal intervals in a circumferential direction, and the stators 7, 8 are fitted at equal intervals via spacers 10 and fixed by cap screws 11, 11 at both side surfaces of the pair of right and left stators 8, 8, whereby the stators 7, 8 are integrated, as shown in detail in FIG. 3. A pair of right and left semi-ring plates 12, 12 each having a rectangular cross-sectional shape (the inside is hollow) and a pair of right and left semi-ring stator guides 13, 13 each having a rectangular cross-sectional shape are attached, by means of cap screws 14, 15, respectively, to both inner side surfaces of the lower casing main body 2*a* where the drive shaft 4 passes through. Then, the integrated stators 7, 8 are inserted into the lower casing main body 2*a* by sliding inner surfaces of the stator guides 13, 13 along side surfaces of the plates 12, 12, and a knob 16 provided in the lower casing main body 2*a* is tightened. Furthermore, bolts 19, 19 are used to attach both ends of the integrated stators 7, 8 to a stator plate 18 that is mounted on flanges 17 provided on the upper surface of the lower casing main body 2*a*, as shown in FIG. 1, whereby the stators 7, 8 are fitted inside the lower casing main body 2*a*.

Stators 7, 8, which are in the same combination and formed into the same shape as the integrated stators 7, 8, are vertically inverted and placed on an upper surface of the stator plate 18. These stators 7, 8 are positioned by aligning pin 20, and consequently the casing main body 2 constituted by the lower part and the upper part is configured such that the ring-like stators 7, 8 are fitted therein.

As shown in FIG. 3, cutout portions 7*a*, 8*a* are formed on circumferential edges of the stators 7, 8, and an adapter 21 having a substantially trapezoidal cross-sectional shape is fixed to each of the cutout portions 7*a*, 8*a* by a cap screw 22. Note that, although not shown, a configuration where the adapter 21 is fixed to each of the cutout portions 7*a*, 8*a* via a spacer is also possible.

As shown in FIG. 1 and FIG. 2, a plurality of circular plates 23 (there are two in the device according to the illustrated embodiment), which are provided between the stators 7, 8 at predetermined intervals via spacers 24 fitted externally into the drive shaft 4, are fixed to the drive shaft 4 by a key 25. Note that the space between the outermost circumferential track surface of each circular plate 23 and an inner circumferential surface of the upper casing main body 2*b* is preferably wide, in terms of preventing adhesion of a processed powder based granules. Also, a plurality of cutout portions 26 are formed in appropriate sections in the center of each circular plate 23 in order to reduce the weight of each circular plate 23 and to allow the powder based granules to move to the adjacent processing chamber through these cutout portions 26.

Figure 4:
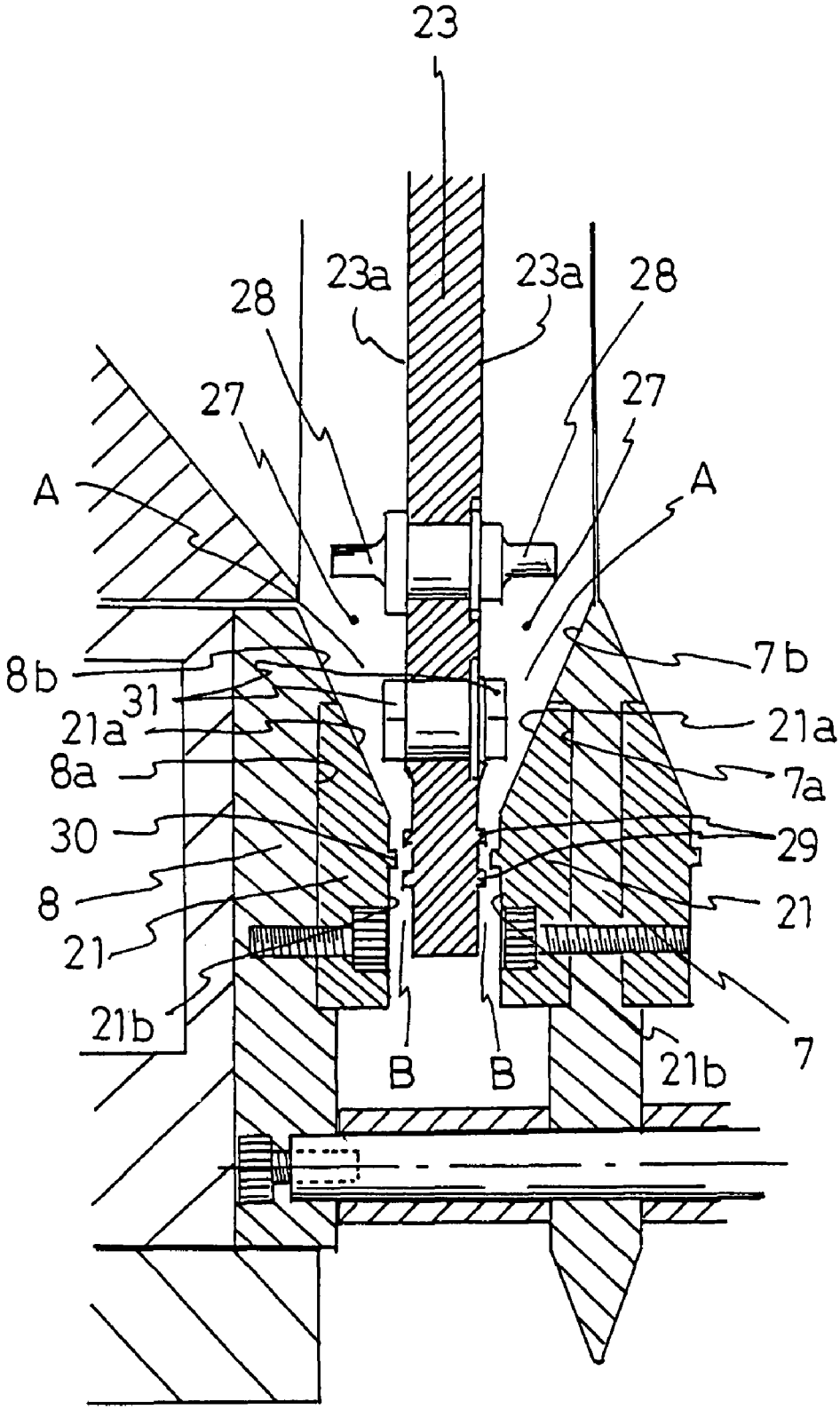
FIG. 4 is a cross-sectional view showing enlarged substantial parts of the device shown in FIG. 1 and FIG. 2.

The stators 7, 8 and the adapters 21, 21 attached to the stators 7, 8 are fitted over the entire circumference of each of the circular plates 23 fitted in the manner described above, so as to sandwich a circumferential edge portion of the circular plate 23, and then, as shown in detail in FIG. 4, a hopper 27 is defined and formed by an outer circumferential edge of the circular plate 23, an inclined surface 7*b* of the stator 7, and an inclined surface 21*a* of the adapter 21 or by the outer circumferential edge of the circular plate 23, an inclined surface 8*b* of the stator 8, and another inclined surface 21*a* of another adapter 21, in the casing main body 2. Also, gap portions A, A, each of which gradually narrows toward the circumferential edge of the circular plate 23, are each formed by the inclined surface 7*b* of the stator 7, the inclined surface 21*a* of the adapter 21, and a plate surface 23*a* of the circular plate 23 or by the inclined surface 8*b* of the stator 8, the inclined surface 21*a* of the adapter 21, and another plate surface 23*a* of the circular plate 23, these surfaces defining and forming the hopper 27. Furthermore, powder based granules disintegrating and sizing portions B, B are each formed between the outermost circumferential edge of the circular plate 23 and each of vertical surfaces 21*b*, 21*b* of the adapters 21, 21, i.e., in a narrowest gap portion of each of the gap portions A, A.

Each of the gaps at the disintegrating and sizing portions (narrowest gap portions) B is set arbitrarily by a target largest grain size of the powder based granules to be processed. Normally it is set to approximately 1.5 through 3 times the target largest grain size of the powder based granules to be processed. This gap of each disintegrating and sizing portion B can be adjusted by changing the thickness of each adapter 21. Specifically, a plurality of adapters 21 of different thickness are prepared, and the gap of each disintegrating and sizing portion B can be narrowed by replacing each adapter 21 with a thick adapter 21. Also, the gap of each disintegrating and sizing portion B can be narrowed by replacing a circular plate 23 with a circular plate 23 having a thick circumferential edge portion.

Here, in a configuration in which a plurality of disintegrating pins 28 for roughly disintegrating the powder based granules are implanted in the inclined surfaces 7*b*, 8*b* of the respective stators 7, 8 and/or the plate surfaces 23*a* of the circular plate 23 that is opposed to the inclined surface 7*b*, 8*b* respectively, the efficiency of disintegrating the powder based granules can be improved by the use of the disintegrating pins 28. Moreover, when the outermost circumferential edge of the circular plate 23 and the surfaces of the adapters 21 opposed thereto are formed into concave-convex surfaces having grooves, projections and the like, respectively, these concave-convex surfaces can function to push the powder based granules smoothly toward the discharge section side or, conversely, to accumulate the powder based granules in each gap portion A, not to mention disintegrating and sizing the powder based granules, whereby the powder based granules can be disintegrated/sized accurately.

Figure 5:
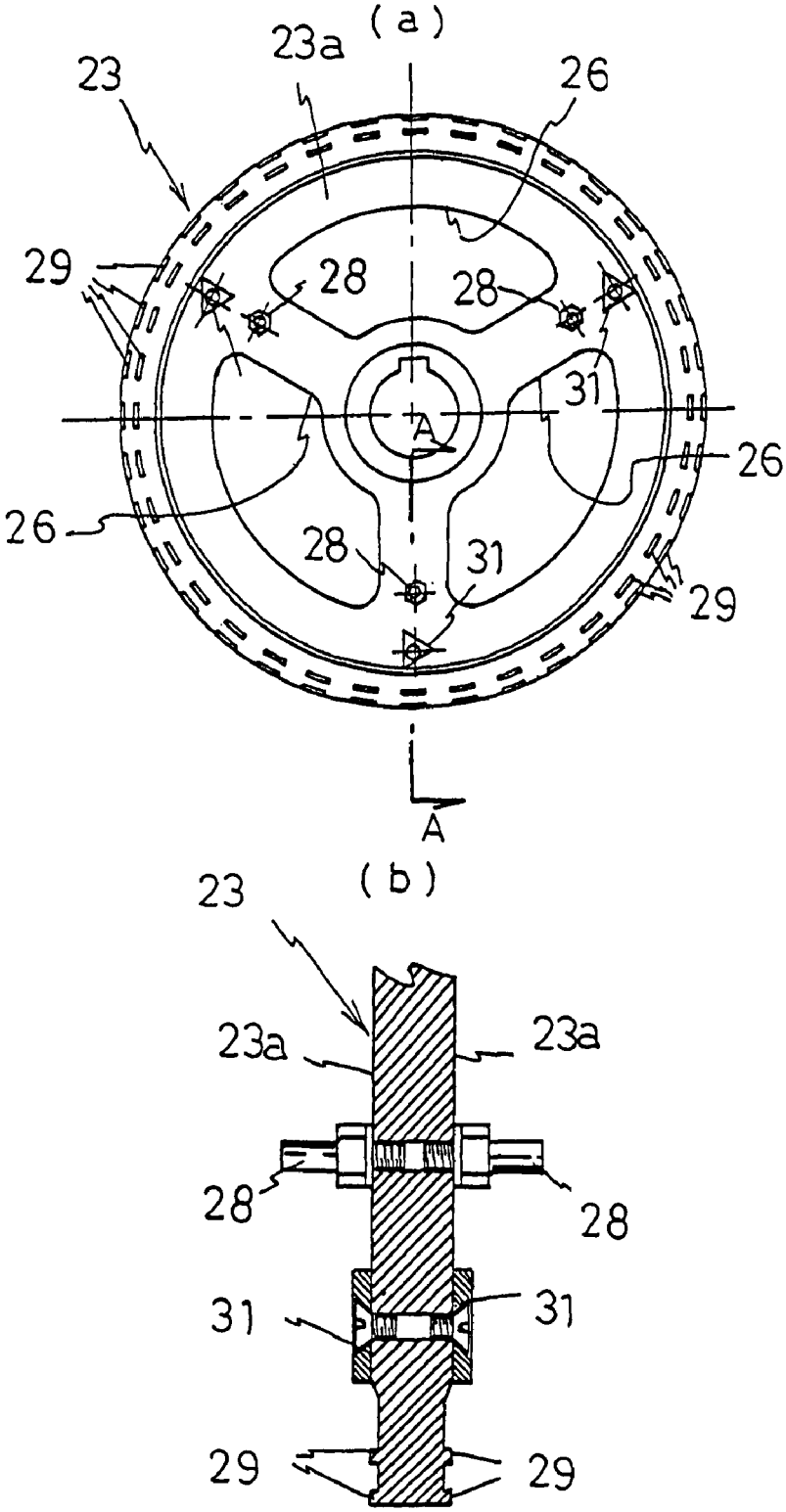
FIG. 5 is a diagram showing an embodiment of a circular plate that is used in the powder based granules disintegrating and sizing device according to the present invention, with (a) being a front view, and (b) being an enlarged cross-sectional view of the section taken along line A-A in the diagram (a).
Figure 6:
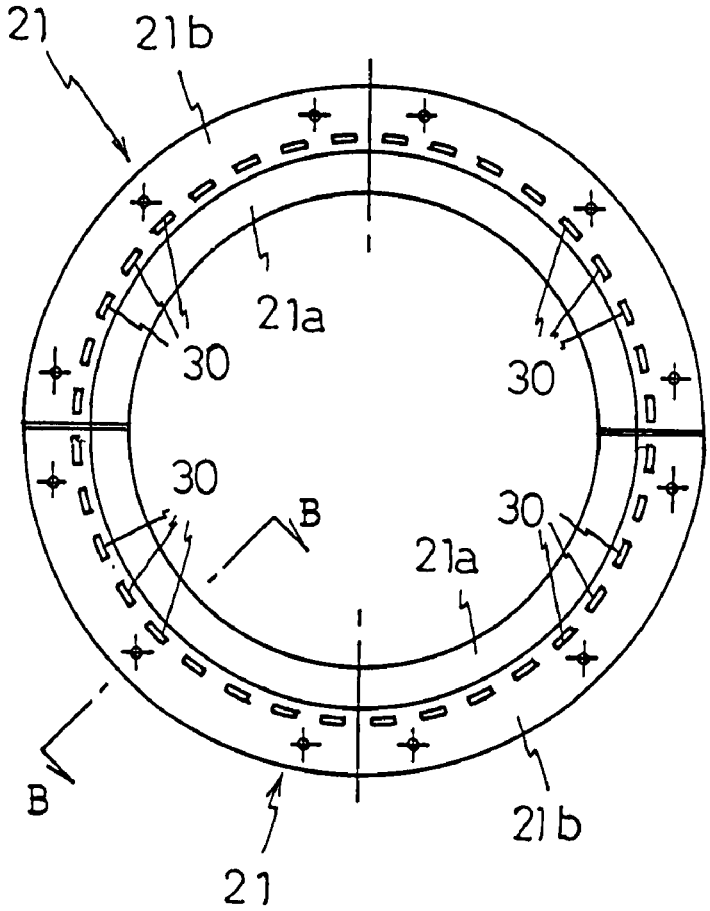
FIG. 6 is a diagram showing an embodiment of an adapter, with (a) being a front view, and (b) being an enlarged cross-sectional view of the section taken along line B-B in the diagram (a).
Figure 6:
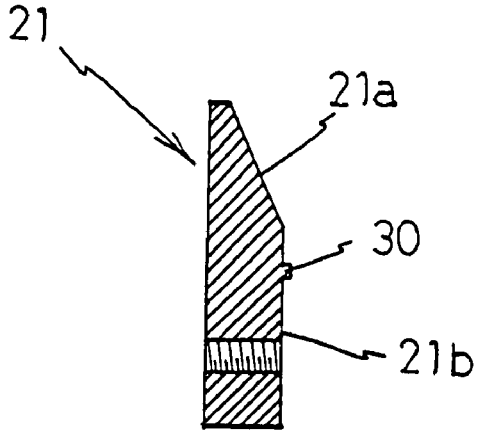
Figure 7:
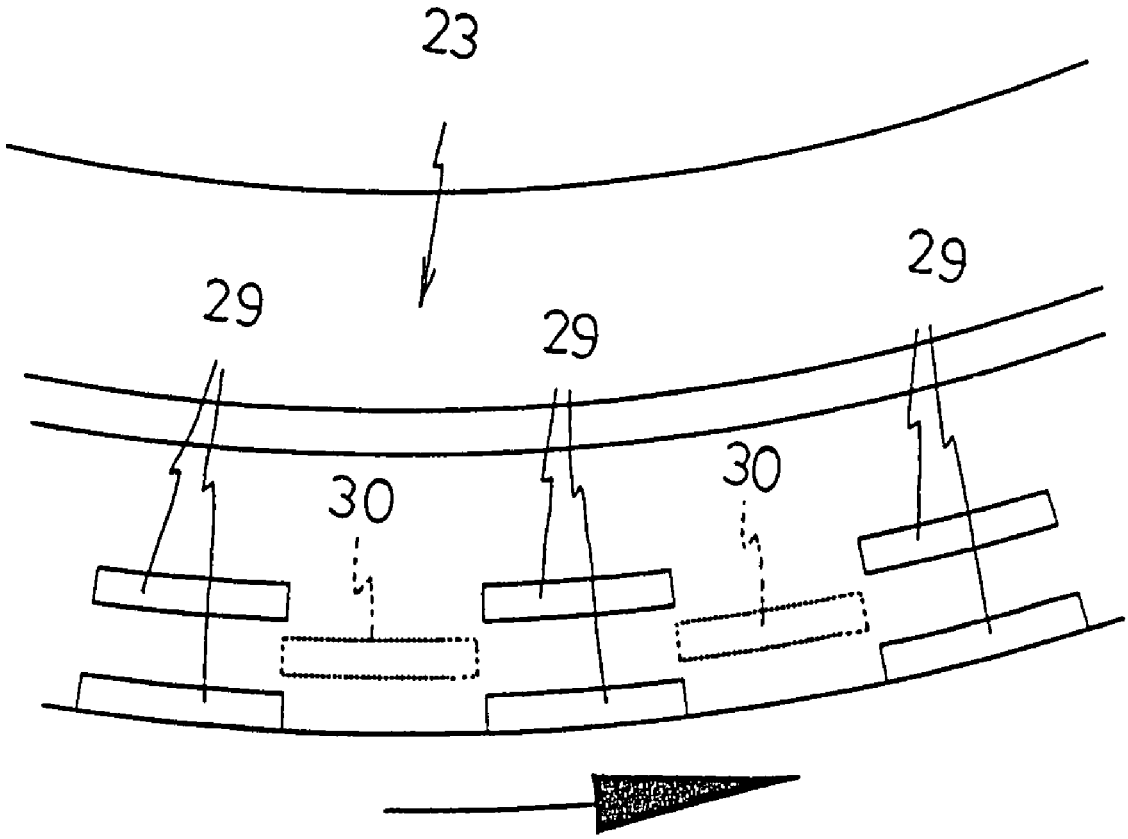
FIG. 7 is an explanatory diagram of a substantial part showing the positional relationship between projections shown in FIG. 5 and FIG. 6.

Specifically, on the outermost circumferential edge plate surface of the circular plate 23, spike-like projections 29 are formed radially in two rows around a rotation shaft core of the circular plate, at predetermined intervals in a radial direction and a circumferential direction, as shown in FIG. 5. On the surface of each adapter 21 that is opposed to the outermost circumferential edge plate surface of the circular plate 23 as well, spike-like projections 30 are formed in one row at predetermined intervals in the circumferential direction on each vertical surface 21*b* continuing into the inclined surface 21*a* of the adapter 21, as shown in FIG. 6. In addition, as shown in FIG. 7, both projections 29, 30 are arranged such that the two rows of projections 29, 29 formed on the outermost circumferential edge plate surface of the circular plate 23 sandwich and pass each of the projections 30 formed on the vertical surface 21*b* of the adapter 21.

As described above, by forming the projections 29, 30 respectively on the circular plate 23 and the surfaces of the adapters 21 that are opposed thereto, the powder based granules that reaches each disintegrating and sizing portion B through each gap portion A formed by the plate surface 23*a* of the circular plate 23, each of the inclined surfaces 7*b*, 8*b* of the stators 7, 8 and each of the inclined surfaces 21*a*, 21*a* of the adapters 21, 21 is disintegrated/sized efficiently by the projections 29, 30 even if the powder based granules is entirely formed of hard dried substances or has a hard core, and the powder based granules is then discharged to the outside and processed without accumulating in this disintegrating and sizing portion B.

The projections 29, 30 are specifically configured such that, for example, if the diameter of one of the circular plates 23 is 26 cm, thirty-six projections 29 are formed per row on the outermost circumferential edge of the circular plate 23, and these two rows of projections 29, 29 are formed in the same positions (in parallel) without shifting the phases thereof in the circumferential direction, wherein the length of each projection 29 in the circumferential direction is approximately 11 mm, the distance between adjacent projections 29, 29 is also approximately 11 mm (they are equally spaced by 5 degrees), the width of each projection 29 in the radial direction is 2 mm, the height of the same is 1 mm, and the distance between the adjacent rows of projections 29 is 4 mm. On the other hand, the dimensions of the projections 30 formed on each of the opposed surfaces of the adapters 21 are substantially the same as those of the projections 29, but the shape of each projection 30 in a plan view may be formed into a shape such as to block the flow of the powder based granules passing through between the projections 29 and 30 (e.g., a substantially parallelogram which is inclined in the direction to block the passage of the powder based granules).

Note that the shape and dimensions of the projections 29, 30 are not limited to those described above and, certainly, can be set arbitrarily. However, when forming the projections, it is necessary that the projections 29, 30 be provided on, respectively, the circular plate 23 and each of the opposed surfaces of the adapters 21, hence when one of the surfaces is, for example, a planar surface, short pass occurs and good disintegrating/sizing cannot be expected. Moreover, although depending on the property of the substance of the powder based granules to be subjected to disintegrating and sizing processing, the circular plates 23 and adapters 21 without the projections 29, 30 may be used.

When the projections 29, 30 are formed as described above, the distance of the narrowest gap of each disintegrating and sizing portion B formed by the outermost circumferential edge of the circular plate 23 and each surface of the adapter 21 opposed thereto is the distance between the leading end of each of the projections formed on one of the opposed surfaces and the other opposed surface. The distance of the narrowest gap is set arbitrarily by the target largest grain size of the powder based granules to be processed (note that the average size depends on not only the distance of the narrowest gap but also the number of rotations of the circular plate and the amount of the powder based granules to be supplied). However, considering the high-speed rotation of the circular plate 23 and the presence of the projections 29, 30, it is dangerous and not preferred to set the distance of the narrowest gap to 0.5 mm or less.

In FIG. 4 and the like, reference numeral 28 indicates the disintegrating pins, as described above. When the material to be supplied is a dried material, the disintegrating pins 28 are for roughly disintegrating the material to be supplied, and are each provided detachably at a predetermined interval on each plate surface 23*a* of the circular plate 23 so as to be positioned slightly above the gap portion A where the powder based granules accumulates, as shown in the diagrams. Specifically, three disintegrating pins 28 are attached to each plate surface 23*a* of the circular plate 23 at intervals of 120 degrees in the circumferential direction, as shown in FIG. 5.

Moreover, as shown in FIG. 4 and the like, reference numeral 31 indicates auxiliary pins, which are each attached to each plate surface 23*a* of the circular plate 23 so as to be positioned in each gap portion A where the powder based granules accumulates. The auxiliary pins 31 function to rapidly push the powder based granules, which is moved to the gap portion A where it accumulates by the centrifugal force generated by the rotation of the circular plate 23, out to each disintegrating and sizing portion B without causing the powder based granules to accumulate in the gap portion A. Each of the auxiliary pins 31 changes the shape thereof appropriately into a round, rectangle, square, triangle and the like in a plan view, and, when the mounting angle is also changed appropriately to check the effect of pushing out the powder based granules, it is preferred that the shape of the auxiliary pin 31 be a substantially triangle in a plan view and be attached such that one of the top points of the triangle is directed in the direction of rotation of the circular plate 23.

On the other hand, the center of the upper part of the upper casing main body 2*b* is provided with a raw material feeding casing 32, as shown in FIG. 1 and FIG. 2. A lower part of the raw material feeding casing 32 is communicated with raw material feeding ports 33, 33 that are formed respectively on side surfaces of the upper casing main body 2*b* through which the drive shaft 4 passes. On the inside of the raw material feeding casing 32, there is fitted a dispersion means 34 for evenly distributing the powder based granules to the both raw material feeding ports 33, 33. This dispersion means 34 is configured such that umbrella-shaped (tectiform) dispersion members 34*a*, 34*b* each having an isosceles triangular cross-sectional shape are attached in two tiers with their top portions up and through out the entire width direction of the raw material feeding casing 32.

Furthermore, as shown in FIG. 2, semi-ring members 35, 35 each having a rectangular cross-sectional shape are fixed by cap screws 36 on the inner side surfaces in the vicinity of the outermost circumference of the upper casing main body 2*b*. In terms of preventing adhesion of the processed powder based granules, the semi-ring members 35, 35 are formed using, for example, PTFE (polytetrafluoroethylene) or other material having a smooth surface. On the side surfaces of the semi-ring members 35, 35 that face each other, notch portions 37, 37 with a certain depth are formed at equal intervals in the radial direction, and a flexible sheet-like member 38 is installed in the notch portions 37, 37. Not only that this sheet-like member 38 is lined on the inner circumferential surface of the upper casing main body 2*b*, but also that both ends of the sheet-like member 38 are suspended downward so as to cover the inner surface of the lower casing main body 2*a*, as shown in FIG. 1. Then, this sheet-like member 38 is also made of, for example, rubber and/or PTFE or other material having a smooth surface, so that the processed powder based granules does not adhere thereto, and, when two of this sheet-like member 38 are layered and used, the ones made of PTFE are fitted on the inside.

A plurality of gas-activated pin cylinders 39 are attached at substantially equal intervals to an outer circumferential surface of the upper casing main body 2*b* and an outer circumferential surface of the lower casing main body 2*a*, as shown in FIG. 1. A pin 39*a* of each pin cylinder 39 is inserted into a hole pierced in each of the casing main bodies 2*a*, 2*b*, and a leading end of the pin 39*a* is set such as to abut against the lined sheet-like member 38.

Semi-ring auxiliary plates 40, 40 each having a right triangular cross-sectional shape are each attached to a corner of the upper part of a side surface of the lower casing main body 2*a* and each semi-ring plate 12 by means of a cap screw 41, 41, concentrically with the drive shaft 4, as shown in FIG. 2. The fed powder based granules is guided to each gap portion A by each of these auxiliary plates 40 without accumulating in this corner portion.

Furthermore, gas supply pipes 42, 42 communicating with the raw material feeding ports 33, 33 formed in the upper casing main body 2*b* are each coupled to the lower part of each side surface of the raw material feeding casing 32. A gas supply pipe 43 communicating with a space between the upper surface of the upper casing main body 2*b* and the umbrella-shaped dispersion member 34 is coupled to the other side surface of the raw material feeding casing 32, and a cutout portion 44 for ejecting gas is formed on the top portion of the umbrella-shaped dispersion member 34*b*. Further, an gas filter, a push/intake blower and an gas heater, which are not shown, are connected to the other ends of the gas supply pipes 42, 43.

Figure 8:
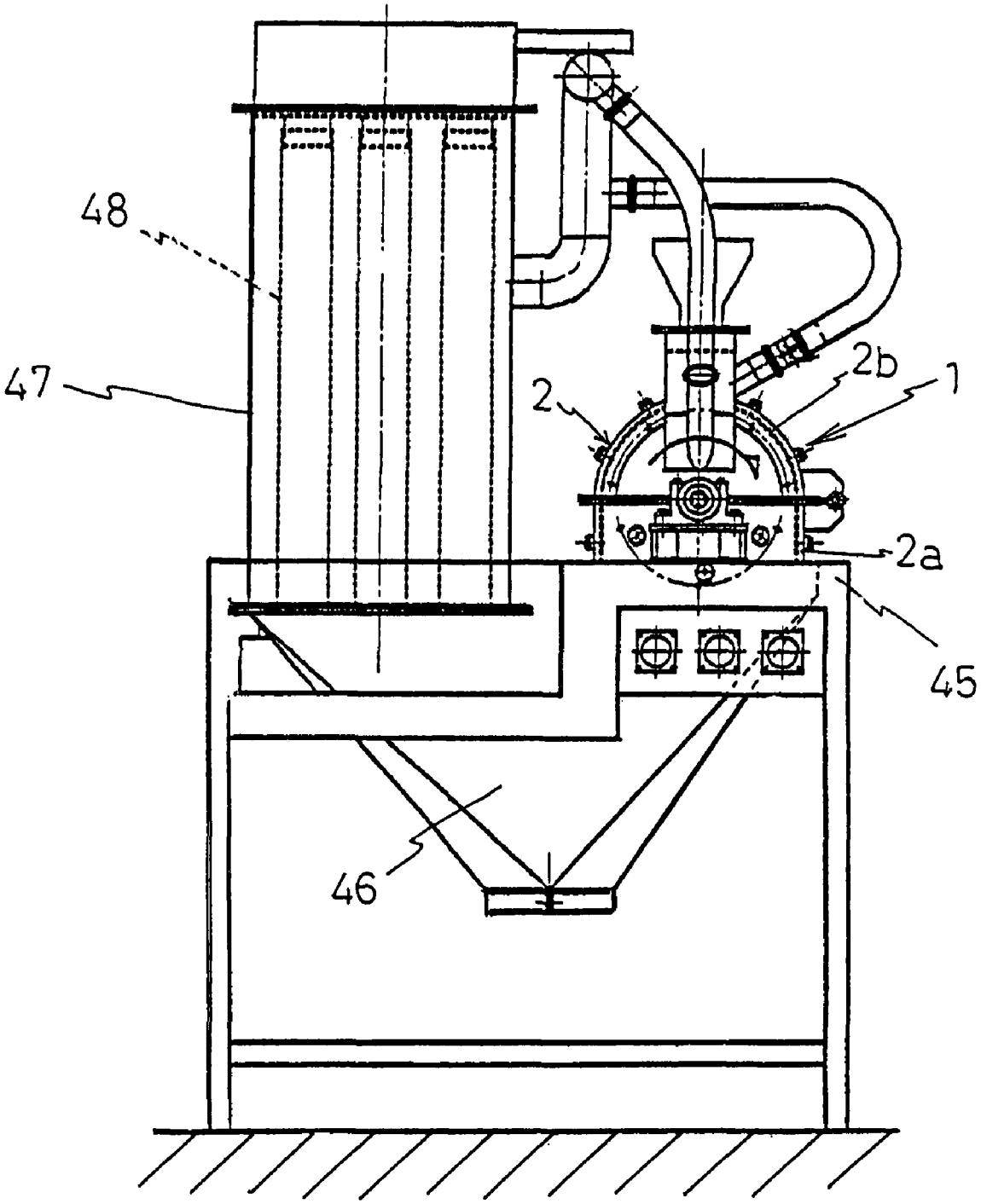
FIG. 8 is a front view schematically showing an embodiment of the entire powder based granules disintegrating and sizing device according to the present invention.

Furthermore, a lower end opening (discharge port) of the lower casing main body 2*a* is fixed on a common base 45 having an opening portion, and a discharging casing 46 having a discharge port at its lower part is provided consecutively below the common base 45, as shown in FIG. 8. Also, a bag collector 47 is fixed on top of the common base 45, and this bag collector 47 is connected to a suction/exhaust blower (not shown) via a piping. In addition, an opening is provided also in the common base 45 that is positioned below the bag collector 47, whereby hot gas having the powder based granules (fine particles) is discharged from this opening to the bag collector 47, and the powder based granules (fine particles) that is brushed off from a bag filter 48 of the bag collector 47 is also discharged from the discharge port to the outside of the system through this opening and then through the discharging casing 46.

The powder based granules disintegrating and sizing device 1 according to the first embodiment of the present invention that is configured as described above is operated in the following manner.

First, the drive shaft 4 is rotated by a motor or the like, not shown, and thereby the circular plates 23 fixedly provided to the drive shaft 4 are rotated. Next, the suction/exhaust blower, push/intake blower, and gas heater (all not shown) are activated in this order to supply hot gas, the temperature of which is increased to a predetermined temperature, into the casing main body 2 via the gas supply pipes 42, 43, and discharged from the lower part of the casing main body 2. At this moment, it is preferred that the amount of gas to be discharged be slightly larger than the amount of gas to be supplied so that the pressure inside the device becomes negative pressure.

The hot gas supplied from the gas supply pipe 43 is ejected from the cutout portion 44 fitted at the top portion of the umbrella-shaped dispersion member 34*b* toward the umbrella-shaped dispersion member 34*a* thereabove, and flows into the device through the gap between the both umbrella-shaped dispersion members 34*a*, 34*b* and then through the raw material feeding casing 32 and raw material feeding ports 33. At this moment, the hot gas heats the both umbrella-shaped dispersion members 34*a*, 34*b* and the raw material feeding casing 32. On the other hand, the hot gas supplied from the gas supply pipe 42 flows from the raw material feeding ports 33 of the upper casing main body 2*b* directly into the device. Then, the hot gas supplied from the gas supply pipe 42 and the hot gas supplied from the gas supply pipe 43 are combined here and move from the center of the inside of the device in the outer circumferential (radial) direction as the circular plates 23 rotate, and some of the hot gas flows from the cutout portions 26 of the circular plates 23 into the adjacent processing chamber to move similarly in the outer circumferential (radial) direction as the circular plates 23 rotate, and then reaches the inner surface of the sheet-like member 38 lined inside the main body via the disintegrating and sizing portion B. In the meantime, the hot gas heats the spacers 24 and the circular plates 23 fitted externally into the drive shaft 4, the disintegrating pins 28 and the auxiliary pins 31 attached to the circular plates 23, the stators 7, 8, the both casing main bodies 2*a*, 2*b*, and the sheet-like member 38 sequentially. Thereafter, the hot gas passes through the opening portion of the common base 45 from a lower opening portion of the lower casing main body 2*a* to enter the bag collector 47 via the discharging casing 46, and is discharged by the suction/exhaust blower, not shown, to the outside of the system. Once the temperature inside the device becomes constant, the pin cylinders 39 are activated according to need, to start backwashing of the bag collector 47.

Next, a powdery granular raw material including wet agglomerated substances granulated or formed by various devices is supplied quantitatively from the raw material feeding casing 32. The supplied powdery granular raw material is first divided evenly into right and left at the top portion of the umbrella-shaped dispersion member 34*a*, flows down inclined surfaces of the umbrella-shaped dispersion members 34*a*, 34*b* and the side surfaces of the raw material feeding casing 32 into the device through the raw material feeding ports 33, 33. Then, the powdery granular raw material that flows into the device passes though the inclined surfaces of the auxiliary plates 40 and is first roughly disintegrated by the disintegrating pins 28. Then, the powder based granules that reaches each of the gap portions A between each circular plate 23 and each of the stators 7, 8 is rapidly pushed out to each of the disintegrating and sizing portions B without accumulating in the gap portions A, by the centrifugal force generated by the rotation of the circular plates 23, the pressing force generated by the action of the auxiliary pins 31, and the suction force generated by the balance between the both push/intake and suction/exhaust venting, not shown. Moreover, the powder based granules that moves from the cutout portions 26 of the circular plates 23 to the adjacent processing chamber is also roughly disintegrated by the disintegrating pins 28, thereafter reaches each of the gap portions A that are each formed between the right or left circular plate 23, 23 and each of the stators 7, 8, and is then rapidly pushed out to each of the disintegrating and sizing portions B due to the same action described above, without accumulating in the gap portions A. Particles of the powder based granules that are fitted to the set gap are allowed to pass directly, the powder based granules being pushed out to the disintegrating and sizing portions B, but particles that are not fitted to the set gap are disintegrated/sized efficiently by the projections 29, 30 provided in the disintegrating and sizing portions B, even if the powder based granules is entirely formed of hard dried substances or has a hard core, and are then discharged in the directions of the both casing main bodies 2*a*, 2*b* without accumulating in the disintegrating and sizing portions B, to reach the sheet-like member 38 lined on the inner surfaces of the both casing main bodies 2*a*, 2*b*.

In the disintegrating/sizing actions described above, in the device according to the present invention, because hot gas is supplied to the inside of the device and each part of the disintegrating and sizing device 1 with which the powder based granules comes into contact is heated by the hot gas, the powder based granules fed into the device is heated directly by the hot gas or indirectly via each part of the device with which the powder based granules comes into contact, and consequently the surface the powder based granules is dried immediately, hence adhesion of the powder based granules to the surface, which is caused by the moisture, can be prevented. Also, because the sheet-like member 38 is lined on the inner surface of each of the casing main bodies 2*a*, 2*b* so that the powder based granules does not adhere to the device easily, adhesion of the powder based granules to the inner surface of each of the casing main bodies 2*a*, 2*b* can be prevented. Moreover, even if the powder based granules adheres to this sheet-like member 38, the adhesion can be removed immediately by the action of the impact of the pin 39*a* of the pin cylinder 39. The powder based granules reaches the sheet-like member 38 moves downward along the surface thereof, and is then discharged from the discharge port located in the lower part of the discharging casing 46 to the outside of the system via the opening portion of the lower casing main body 2*a* and the opening portion of the common base 45. At this moment, a newborn surface of a particle generated by disintegrating the powder based granules also is dried immediately by the hot gas so that the disintegrated and sized powder based granules does not adhere to each part inside the disintegrating and sizing device 1. On the other hand, fine particles that are generated by the disintegrating and sizing actions follow the flow of the hot gas to flow from the discharging casing 46 to the bag collector 47, and then are collected on the surface of the bag filter 48.

Next, a powder based granules disintegrating and sizing device according to the present invention that is shown in FIG. 9 through FIG. 14 will be described.

A powder based granules disintegrating and sizing device 51 according to the second embodiment of the present invention, which is shown in FIG. 9 through FIG. 13, differs widely from the device 1 of the first embodiment in that the space between the circular plates is wider, the raw material feeding ports are provided between the circular plates in addition to the right and left raw material feeding ports, and a raw material is supplied evenly to the sizing portions (the gap portions A and the disintegrating and sizing portions B) without relying on the cutout portions formed on each circular plate. Therefore, the second embodiment is described hereinafter based on this difference. Note that the members that are identical to those of the device 1 of the first embodiment are applied with the same reference numerals, and the explanations thereof are sometimes omitted.

Figure 9:
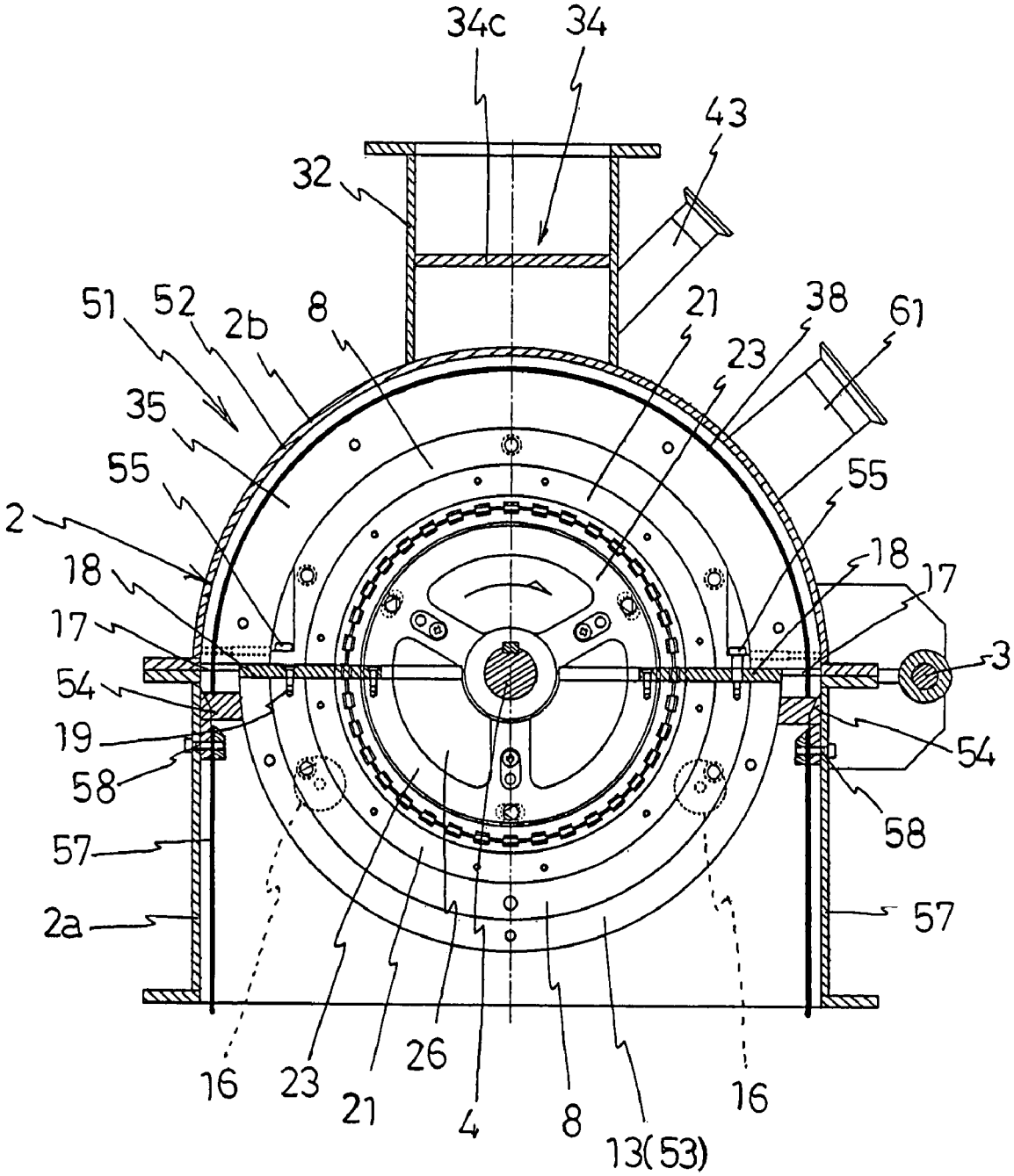
FIG. 9 is a longitudinal cross-sectional front view showing a second embodiment of the powder based granules disintegrating and sizing device according to the present invention.
Figure 10:
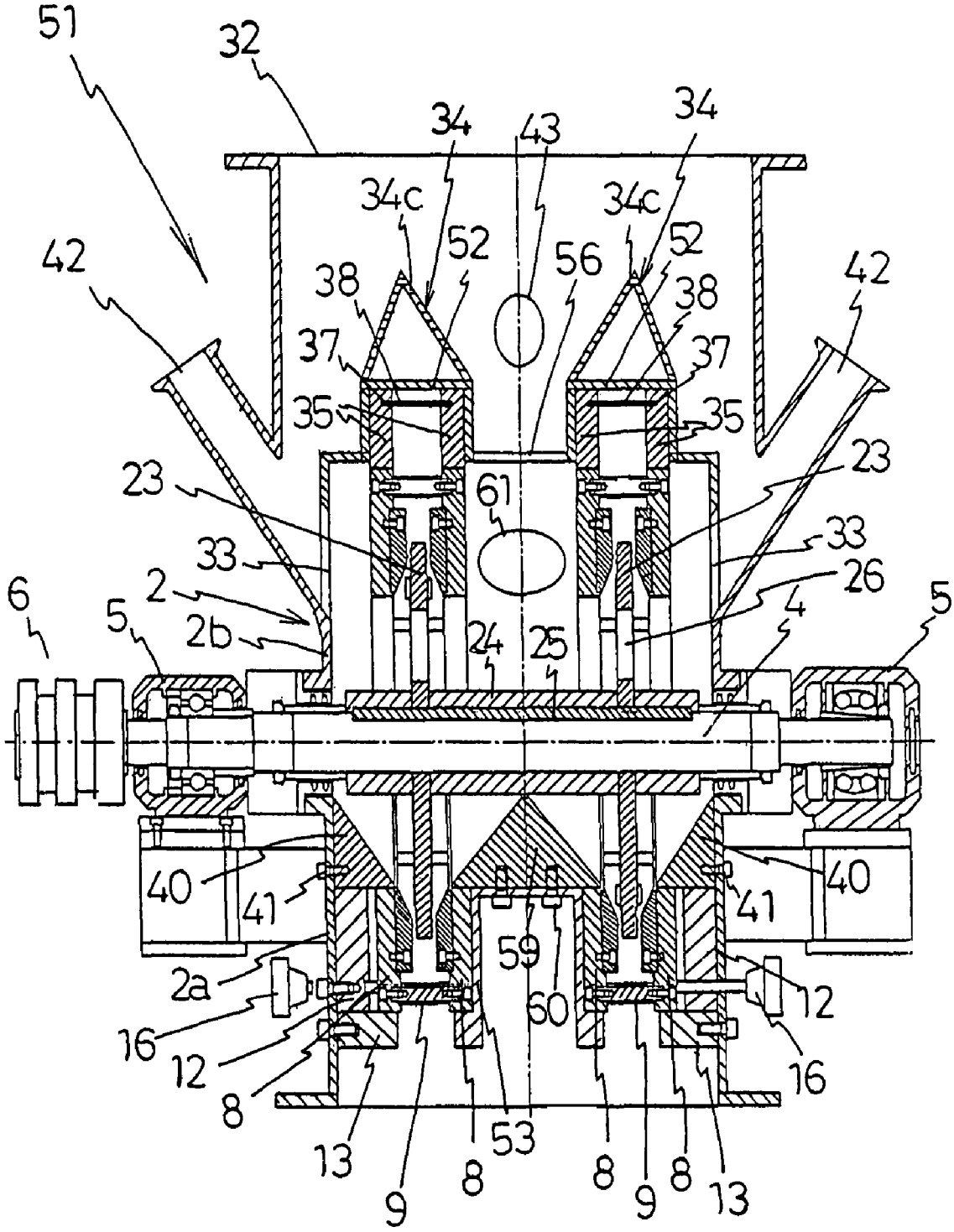
FIG. 10 is a longitudinal cross-sectional side view of this device.

In the powder based granules disintegrating and sizing device 51 according to the present invention, the upper casing main body 2*b* has a semi-cylindrical shape, and semi-ring hollow projections 52, 52 concentric with the upper casing main body 2*b* are provided in the direction of the shaft in two sections over the entire outer circumferential portion of the upper casing main body 2*b*, as shown in FIG. 9 and FIG. 10.

In the lower casing main body 2*a*, two pairs of right and left semi-arc shaped stators 8, 8 each having a substantially right triangular cross-sectional shape are fitted, with the respective top portions thereof facing the drive shaft 4. A fixed axis 9 is inserted into each of a plurality of through-holes of the stators 7, 8 that are provided at equal intervals in a radial direction and at equal intervals in a circumferential direction, and each pair of stators 8, 8 are fitted at equal intervals via spacers 10 and fixed by cap screws 11, 11 at both side surfaces of the both pairs of stators 8, 8, whereby the stators 8, 8 are integrated, as shown in detail in FIG. 11. A pair of right and left semi-ring plates 12, 12 each having a rectangular cross-sectional shape and a pair of right and left semi-ring stator guides 13, 13 each having a rectangular cross-sectional shape are attached, by means of cap screws 14, 15, respectively, to the inside of both side surfaces of the lower casing main body 2*a* where the drive shaft 4 passes through. Furthermore, at the center inside the lower casing main body 2*a*, a semi-ring stator guide 53 having a substantially U cross-sectional shape is attached, by means of bolts or the like, to mounting seats 54, 54 which are fixed to the inner side surfaces on the other side of the lower casing main body 2*a*.

Then, the integrated stators 8, 8 are inserted into the lower casing main body 2*a* by sliding inner surfaces of the stator guides 13 and inner surfaces of flange-like projections 53*a* of the stator guide 53 along a side surface of each plate 12 and a side surface of the stator guide 53, and right and left knobs 16, 16 that are provided respectively on both side surfaces of the lower casing main body 2*a* are tightened. Furthermore, bolts 19, 19 are used to attach both end surfaces of the integrated semi-arc shaped stators 8, 8 to a stator plate 18 that is mounted on flanges 17 provided on the upper surface of the lower casing main body 2*a*, as shown in FIG. 9, whereby each pair of stators 8, 8 are fitted inside the lower casing main body 2*a*.

Figure 14:
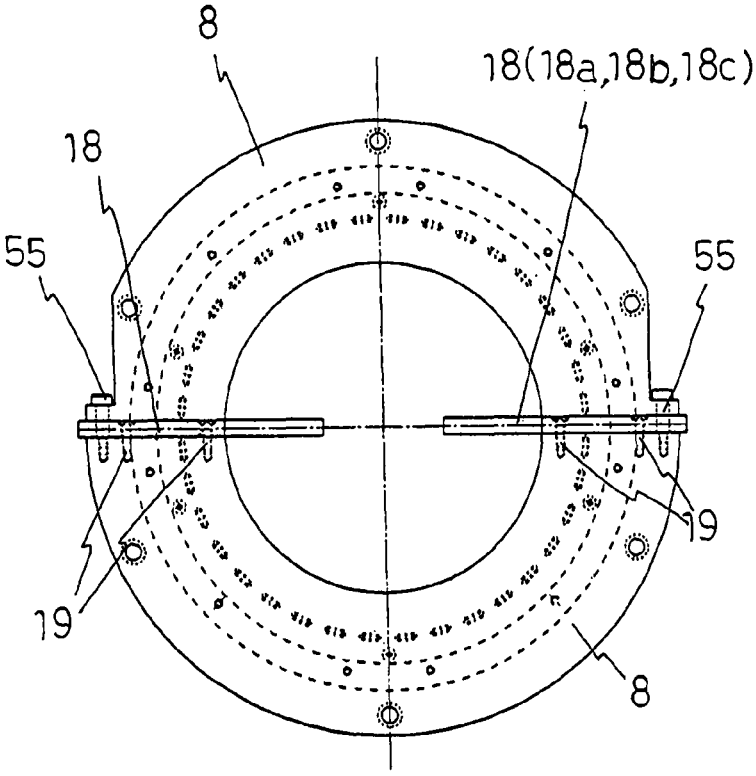

Then, two pairs of stators 8, 8, which are in the same combination and formed into the same shape as the integrated stators 8, 8, are vertically inverted and placed on an upper surface of the stator plate 18, as shown in FIG. 14. These stators 8, 8 are fixed to the upper surface of the stator plate 18 by bolts 55, 55, whereby, in the casing main body 2 constituted by the lower part and the upper part, the ring stators 8, 8 forming two pairs are fitted so as to be positioned in the semi-ring hollow protrusions 52, 52 provided in the upper casing main body 2*b*, as shown in FIG. 10.

Figure 13:
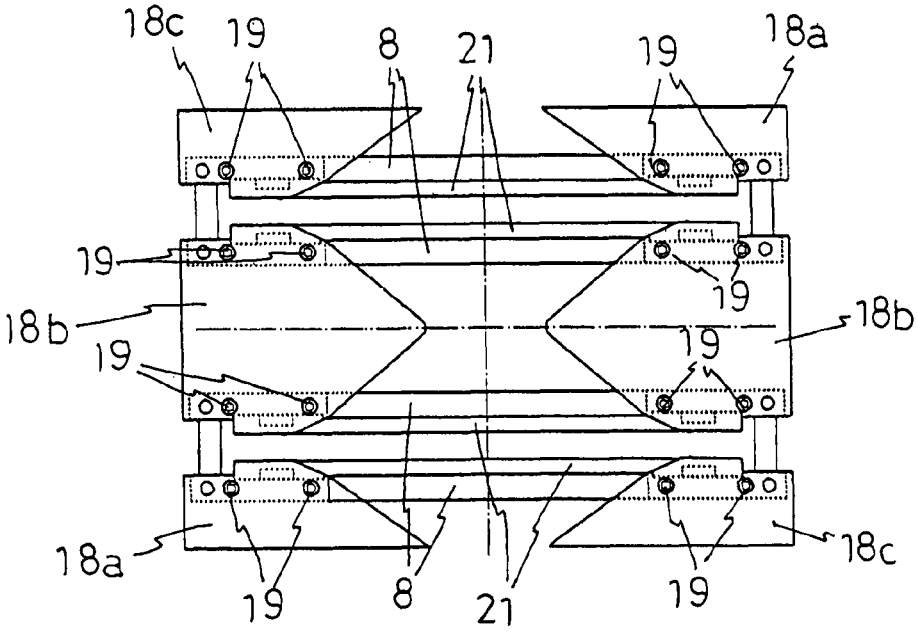
FIG. 13 and FIG. 14 are each an explanatory diagram of an attachment structure of stators of the device shown in FIG. 9 and FIG. 10, with FIG. 13 being a plan view of the shape and arrangement of a stator plate, and FIG. 14 being a front view of the stator plate and the stators fitted thereabove and therebelow.

Note that the stator plate 18 described above is configured by divided three members 18*a*, 18*b* and 18*c*, as shown in FIG. 13.

Figure 11:
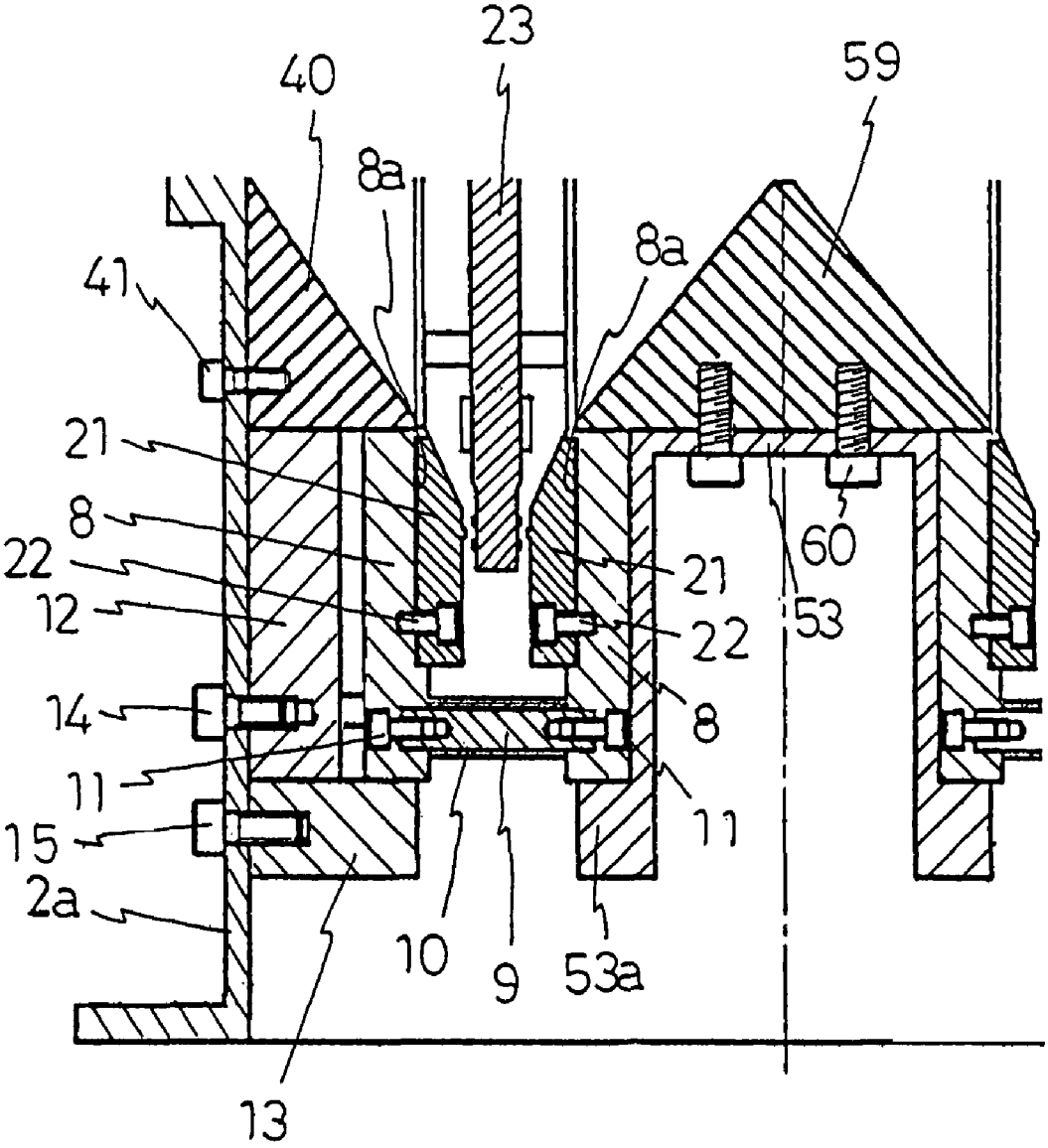
FIG. 11 is a cross-sectional view showing enlarged substantial parts of the device shown in FIG. 9 and FIG. 10.
Figure 12:
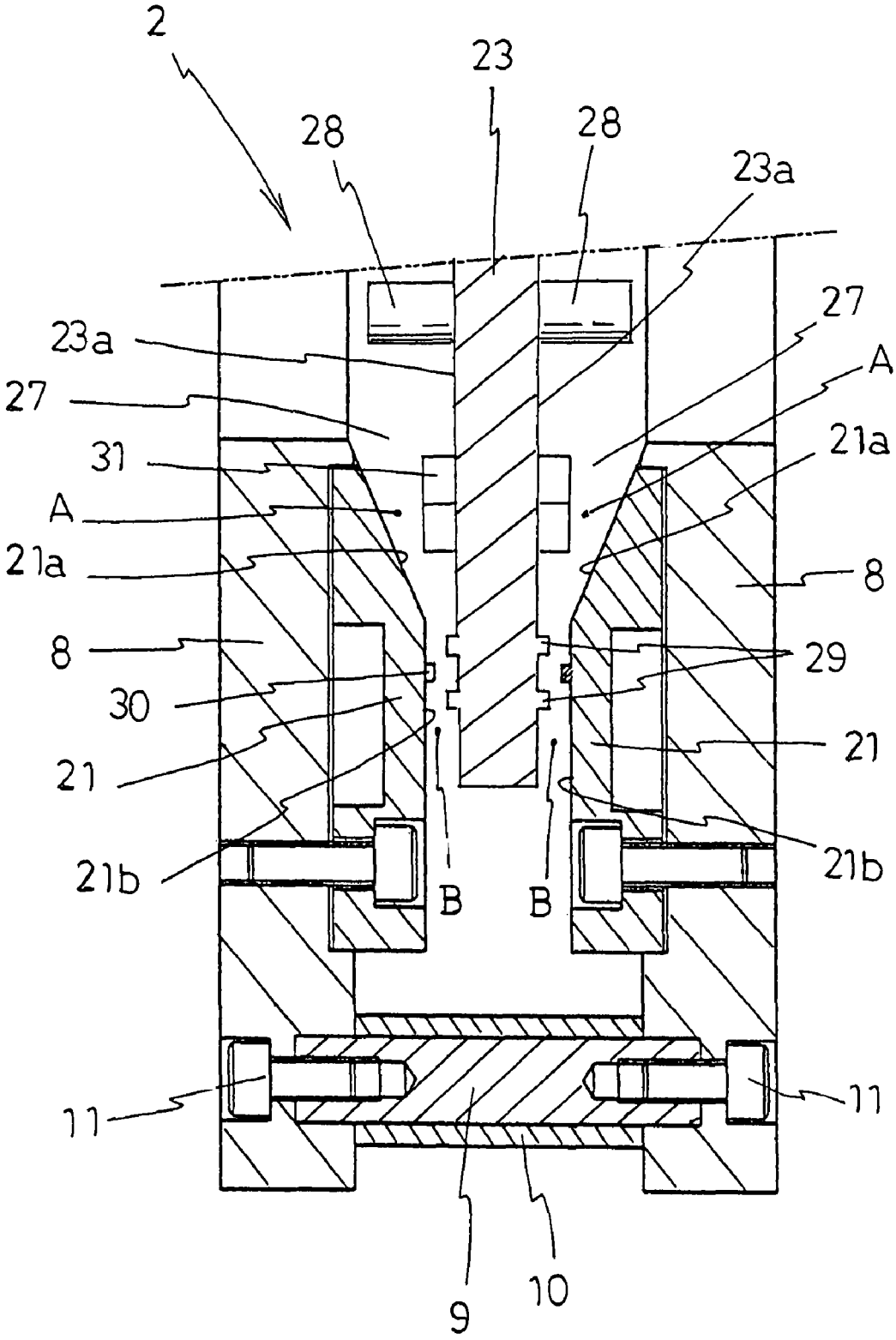
FIG. 12 is a cross-sectional view showing enlarged substantial parts of the device shown in FIG. 9 and FIG. 10.

As shown in FIG. 11, cutout portions 8*a*, 8*a* are formed respectively on side surfaces of the stators 8, 8 that are opposed to each other and semi-arc shaped adapters 21 each having a substantially trapezoidal cross-sectional shape are fixed to the cutout portions 8*a*, 8*a* by cap screws 22 respectively.

On the other hand, as shown in FIG. 9 and FIG. 10, two circular plates 23, 23 are each fixed to the drive shaft 4 by a key 25 so as to be positioned between each of the two pairs of stators 8, 8 at predetermined intervals via spacers 24 that are fitted externally to the drive shaft 4.

Note that, as with the device 1 according to the first embodiment described above, a plurality of cutout portions 26 are formed in appropriate sections in the center of each circular plate 23 in order to reduce the weight of each circular plate 23, but these cutout portions 26 are not always necessary in the device 51 of the present embodiment The stators 8, 8 and the adapters 21, 21 attached to the stators 8, 8 are fitted over the entire circumference of each of the two circular plates 23, 23 fitted in the manner described above, so as to sandwich a circumferential edge portion of each circular plate 23. Then, as shown in detail in FIG. 12, in the casing main body 2, the hopper 27 is defined and formed by an outer circumferential edge of the circular plate 23 and each of inclined surfaces 21*a*, 21*a* of the adapters 21, 21, and gap portions A, A, each of which gradually narrows toward the circumferential edge of the circular plate 23, are each formed between each of the inclined surfaces 21*a*, 21*a* of the adapters 21, 21 and each of plate surfaces 23*a*, 23*a* of the circular plate 23, these surfaces defining and forming the hopper 27. Furthermore, powder based granules disintegrating and sizing portions B, B are each formed between the outermost circumferential edge of the circular plate 23 and each of vertical surfaces 21*b*, 21*b* of the adapters 21, 21, i.e., in a narrowest gap portion of each of the gap portions A, A.

Furthermore, as with the device 1 according to the first embodiment described above, each of the plate surfaces 23*a* of the circular plate 23 described above is provided with a disintegrating pin 28 for roughly disintegrating the powder based granules and an auxiliary pin 31 that functions to rapidly push the powder based granules out from each of the gap portions A to each of the disintegrating and sizing portions B. Moreover, the surface of the circular plate 23 and the surface of each of the adapters 21 that are opposed to each other and configure each disintegrating and sizing portion B are provided with, respectively, projections 29, 30.

In addition, the center of the upper part of the upper casing main body 2*b* is provided with a raw material feeding casing 32, as shown in FIG. 10, and a lower part of the raw material feeding casing 32 is communicated with raw material feeding ports 33, 33 that are each formed on each side surface of the upper casing main body 2*b* and with a raw material feeding port 56 formed between the semi-ring hollow projections 52, 52 provided in the upper casing main body 2*b*. On the inside of the raw material feeding casing 32, there are fitted dispersion means 34 for evenly distributing the powder based granules to the raw material feeding ports 33, 33 and 56. Each of the dispersion means 34 is configured such that umbrella-shaped dispersion members 34*c*, the base widths of which are equal to the widths of the semi-ring hollow projections 52 and each of which has a triangular cross-sectional shape, are provided in two tiers throughout the entire width direction of the raw material feeding casing 32, with their top portions up and bottom portions (bases) attached respectively to outer circumferential surfaces of the semi-ring hollow projections 52.

As shown in FIG. 10, semi-ring members 35, 35 each having a rectangular cross-sectional shape are fixed, by cap screws (not shown), to an inner side surface of each of the semi-ring hollow projections 52, 52 positioned respectively in the outer circumferential edge portions of the two pairs of stators 8, 8. In terms of preventing adhesion of the processed powder based granules, the semi-ring members 35, 35 are formed using a material having a smooth surface, as with the device 1 according to the first embodiment described above. On the side surfaces of the semi-ring members 35, 35 that are opposed to each other, notch portions 37, 37 with a certain depth are formed at equal intervals in the radial direction, respectively, and a flexible sheet-like member 38 is installed in the notch portions 37, 37. However, in the device 51 according to this embodiment, the sheet-like member 38 is lined on the inner circumferential surface of the upper casing main body 2*b*, and another sheet-like member 57 is fixed to the lower casing main body 2*a* by a different bolt 58, as shown in FIG. 9.

Note that a pin cylinder for vibrating the lined sheet members 38, 57 may be provided on the outer circumferential surface of the upper casing main body 2*b* and the outer circumferential surface of the lower casing main body 2*a*, as with the device 1 according to the first embodiment described above, but the pin cylinder is not necessarily provided when the device is configured for supplying hot gas.

Semi-ring auxiliary plates 40, 40 each having a right triangular cross-sectional shape are each attached to a corner of the upper part of an inner side surface of the lower casing main body 2*a* and each of the semi-ring plates 12, 12 by means of a cap screw 41, 41, concentrically with the drive shaft 4, as shown in FIG. 10. Also, as shown in FIG. 10, a semi-ring auxiliary plate 59 having an isosceles triangular cross-sectional shape is attached to an inner projection of the stator guide 53 having a substantially U cross-sectional shape, by means of a cap screw 60, concentrically with the drive shaft 4. The fed powder based granules is guided to each gap portion A by these auxiliary plates 40, 59 without accumulating in the abovementioned corner portion and projection of the stator guide 53.

In addition, gas supply pipes 42, 42 communicating with the raw material feeding ports 33, 33 formed in the upper casing main body 2*b* are each coupled to the lower part of each side surface of the raw material feeding casing 32, and a gas supply pipe 43 communicating with the raw material feeding port 56 formed between the semi-ring hollow projections 52, 52 provided in the upper casing main body 2*b* is coupled to the other side surface of the raw material feeding casing 32. Moreover, a gas supply pipe 61 that is opened directly between the semi-ring hollow projections 52, 52 is coupled to the upper casing main body 2*b*. Then, an gas filter, a suction blower and an gas heater, which are not shown, are connected to the other ends of the gas supply pipes 42, 43, 61.

The device 51 with the above-described structure according to the second embodiment is mounted on the common base 45 shown in FIG. 8, as with the device 1 according to the first embodiment, and is used for disintegrating and sizing the powder based granules by performing the same operation as that of the device 1 according to the first embodiment.

In this regard, particularly in the case of the device 51 according to the second embodiment described above, because the raw material feeding port 56 is provided between the circular plates 23, 23 as well, the raw material feeding port 56 provided between the circular plates can be used to evenly supply the raw material to the sizing portions (the gap portions A and the disintegrating and sizing portions B) without relying on the cutout portions 26 formed on each circular plate 23. Moreover, even when the number of circular plates 23 is increased in order to increase the throughput, that is, even when the number of sizing portions is increased in the direction of the drive shaft 4, the raw material can be supplied evenly to the sizing portions by similarly providing the raw material feeding port 56 between the circular plates 23.

Although the above has described the preferred embodiments of the powder based granules disintegrating and sizing device according to the present invention, the present invention is not limited to the described embodiments, and, of course, various modifications and changes thereof can be made within the scope of the technical concept of the present invention that is described in the patent claims.

For example, in the embodiments described above, the powder based granules is heated and dried by supplying hot gas into the device via the gas supply pipes, but a configuration is possible in which the powder based granules is heated and dried by covering the outside of the device with a ribbon-type electric heater or forming each powder contact portion of the device into a jacket structure and supplying hot water or heating steam into the jacket to heat the jacket. Alternatively, on the other hand, in a configuration in which a method for supplying cold gas into the device via the gas supply pipes is used for directly or indirectly cooling a processed substance to be disintegrated and sized, disintegrating and sizing processing can be performed on a material having a low softening temperature, such as chocolate, and adhesion of softened and melted substances to the device can be prevented. Moreover, in the above embodiments, although the pin cylinder was described as the means for applying an impact to the sheet-like member lined within the device, but the means for applying an impact is not limited to the pin cylinders, and thus vibrators or other various vibrating or impact generating means can be employed. Moreover, the above embodiments have described the powder based granules processing method used when the device of the present invention is used as a single unit, but the device of the present invention can be used as a part of a series of plants by connecting the powder based granules feeding casing of the device of the present invention with a discharge pipe provided in various granulating machines or molding machines in a previous stage and connecting the discharging casing of the device of the present invention with a supply port provided in various devices in a subsequent stage.

Next, test examples of the present invention will be described.

<Preparation of Powder Based Granules>

Water was added to a ceramic powder body (china clay) to prepare raw materials by using a backflow type high-speed mixer (produced by Nippon Eirich Co., Ltd.; Eirich intensive mixer, Type-R11). Table 1 and Table 2 show the diameter of the particles and moisture content of each raw material.

TEST EXAMPLE

Comparison Test with a Conventional Device

Test Example 1

A conventional device, which has a processing portion in a bottom half thereof only and is described in Patent Literature (WO 2004/085069A1), was used to perform a disintegrating and sizing operation on the prepared raw materials under the following conditions.

| |
|---|
| Diameter of circular plate: 260 mm |
| Number of rotations of circular plate: 3000 rpm |
| Feed amount of raw material: 1.7 t/hr |
| Number of circular plates: 3 |
| Narrowest gap portion: 0.8 mm |

Test Example 2

The device of the present invention shown in FIG. 1 through FIG. 8 was used to perform the disintegrating and sizing operation on the prepared raw materials under the following conditions.

Diameter of circular plate: 260 mm
Number of rotations of circular plate: 3500 rpm
Temperature of hot gas: 80 ° C.
Pin cylinder: Not used
Number of circular plates: 2
Narrowest gap portion: 0.8 mm
Amount of hot gas: 3 $m^3$/min
Feed amount of raw material: 2.0 t/hr Test Example 3

The device of the present invention shown in FIG. 1 through FIG. 8 was used to perform the disintegrating and sizing operation on the prepared raw materials under the following conditions.

Diameter of circular plate: 260 mm
Number of rotations of circular plate: 2500 rpm
Temperature of hot gas: 120° C.
Pin cylinder: Not used
Number of circular plates: 2
Narrowest gap portion: 0.8 mm
Amount of hot gas: 9 $m^3$/min
Feed amount of raw material: 2.0 t/hr Test Results The result of each test is described in Table 1.

TABLE 1

| | Raw Material | | | Processing Result | | | | |
|---|---|---|---|---|---|---|---|---|
| \ | Grain size Dp50 | Grain size Dp90 | Moisture content | Grain size Dp50 | Grain size Dp90 | Moisture content | Processing time | Remarks |
| Test Ex. 1 | 0.6 mm | 2.1 mm | 11.8% | 0.4 mm | 0.9 mm | 11.8% | 80 sec | Adhered |
| Test Ex. 2 | 0.8 mm | 2.8 mm | 12.4% | 0.4 mm | 1.0 mm | 12.0% | 12 min | No problem |
| Test Ex. 3 | 0.9 mm | 3.0 mm | 13.0% | 0.4 mm | 0.6 mm | 12.1% | 5.5 hr | No problem |

*Dp50 indicates the grain size (average grain diameter) of accumulation 50%, and Dp90 indicates the grain size of accumulation 90%.

Test Consideration

When the narrowest gap portion was set to 0.8 mm with a target of a particle having a top size of 1 mm, the goal was nearly achieved in any of the test examples. However, in Test Example 1 the processed product adhered to the narrowest gap portion in 80 seconds after the start of the operation, hence the operation could not be performed. On the other hand, no adhering matter was observed when the processing time was 12 minutes in Test Example 2 and longer than that in Test Example 3, hence it was confirmed that a continuous operation was possible in the device according to the present invention.

Effect Confirmation Test of Pin Cylinder

Test Example 4

The device of the present invention shown in FIG. 1 through FIG. 8 was used to perform the disintegrating and sizing operation on the prepared raw materials under the following conditions.

Diameter of circular plate: 260 mm
Number of rotations of circular plate: 3000 rpm
Amount of hot gas: 3 $m^3$/min (Unheated room-temperature gas)
Pin cylinder: Not used
Number of circular plates: 2
Narrowest gap portion: 1.5 mm
Feed amount of raw material: 1.17 t/hr Test Example 5

The device of the present invention shown in FIG. 1 through FIG. 8 was used to perform the disintegrating and sizing operation on the prepared raw materials under the following conditions.

Diameter of circular plate: 260 mm
Number of rotations of circular plate: 2500 rpm
Amount of hot gas: 3 $m^3$/min (Unheated room-temperature gas)

-continued

Pin cylinder: Used
Number of circular plates: 2
Narrowest gap portion: 1.5 mm
Feed amount of raw material: 1.26 t/hr Test Results The result of each test is described in Table 2.

TABLE 2

| | Raw Material | | | Processing Result | | | | |
|---|---|---|---|---|---|---|---|---|
| \ | Grain size Dp50 | Grain size Dp80 | Moisture content | Grain size Dp50 | Grain size Dp80 | Moisture content | Processing time | Remarks |
| Test Ex. 4 | 0.7 mm | 2.1 mm | 11.1% | 0.2 mm | 0.7 mm | 11.1% | 108 sec | Adhered |
| Test Ex. 5 | 0.7 mm | 2.0 mm | 11.5% | 0.2 mm | 0.7 mm | 11.0% | 12 min | No problem |

*Dp80 indicates the grain size of accumulation 80%.

Test Consideration

In Test Example 4, the processed product obtained immediately after sizing was deposited in the device in 108 seconds after the start of the operation and thereby could not be discharged, hence it was difficult to perform the operation. However, in Test Example 5, although a larger feed amount was processed for 12 minutes, deposition as described above was not observed, hence it was confirmed that a continuous operation was possible.

INDUSTRIAL APPLICABILITY

The powder based granules disintegrating and sizing device according to the present invention described above is a powder based granules disintegrating and sizing device, which is compact, capable of obtaining a sufficiently large disintegrating and sizing area, capable of preventing a powder based granules to be sized from adhering to an inner surface of the device even when the powder based granules is a highly wet material, capable of removing the powder based granules in the early stage even if it adheres to the inner surface of the device, and capable of being operated stable for a long time. Therefore, this powder based granules disintegrating and sizing device is adopted for sizing a variety of wet or dried materials, such as drugs, foods, fodder, chemicals, fertilizers, fine coals, limestone and ceramic materials that are granulated or molded by various devices, into a predetermined grain size.

The invention claimed is:

1. A powder based granules disintegrating and sizing device, comprising:

a drive shaft that is inserted horizontally in a casing main body;

a plurality of circular plates that are fixedly supported at intervals by the drive shaft; and a plurality of stators, each being arranged opposed to a circular plate surface at a circumferential edge portion of respective circular plates of the plurality of circular plates, each stator and respective circular plates of the plurality of circular plate including:

each stator having a flat surface facing the circular plate surface, the flat surface of each stator having an inner stator flat surface and an outer stator flat surface relative to a center of the circular plate surface, a sizing gap being formed by an opening between the outer stator flat surface and the circular plate surface, the outer stator flat surface extending parallel to the circular plate surface, whereby powder based granules having a size less than a width of the sizing gap pass through the opening, the inner stator flat surface being inclined relative to the circular plate with a distance between the inner stator flat surface being wider near the center of the circular plate and becoming narrower toward the outer stator flat surface, the inner stator flat surface ending at the outer stator flat surface and forming a border therebetween, and the sizing gap beginning at the border and extending between the outer stator flat surface and the circular plate, whereby powder based granules having a size greater than the width of the sizing gap accumulate above the sizing gap for disintegration and sizing, wherein each stator stretches over the entire circumference of the respective circular plates, and raw material feeding ports are provided on a side wall in the vicinity of the drive shaft of the casing main body and on an upper circumferential wall of the casing main body located between adjacent circular plates of the plurality of circular plates.

2. The powder based granules disintegrating and sizing device according to claim 1, wherein an upper part of the casing main body is formed into a semi-cylindrical shape concentric with a shaft core of the drive shaft, semi-ring hollow projections concentric with the upper part are provided in a direction of the shaft in a plurality of sections over the entire outer circumferential portion of the upper part, the respective circular plates are fitted in the semi-ring hollow projections, and the raw material feeding port is provided on a circumferential wall between the semi-ring hollow projections.

3. The powder based granules disintegrating and sizing device according to claim 1, wherein an upper part of the casing main body is formed into a semi-cylindrical shape concentric with a shaft core of the drive shaft, and a sheet member with a smooth surface is lined in at least a part of an inner circumferential surface of the semi-cylindrical upper part of the casing main body.

4. The powder based granules disintegrating and sizing device according to claim 1, wherein a gas supply pipe communicating with the raw material feeding port of the casing main body is provided, and a gas discharge path is connected to a discharge port that is provided in a lower part of the casing main body.

5. The powder based granules disintegrating and sizing device according to claim 1, wherein a cutout portion is formed on a circumferential edge of the stator, and an adapter is fitted in the cutout portion.

6. The powder based granules disintegrating and sizing device according to claim 1, wherein projections are provided respectively on opposed surfaces of the respective circular plates and the stator that configure the disintegrating and sizing portion.

7. A powder based granules disintegrating and sizing method, which comprises:

providing a powder based granules disintegrating and sizing device, including:

a drive shaft that is inserted horizontally in a casing main body;

a plurality of circular plates that are fixedly supported at intervals by the drive shaft; and stators being arranged opposed to a circular plate surface at a circumferential edge portion of respective circular plates of the plurality of circular plates, the stators and respective circular plates of the plurality of circular plates including:

the stators having a flat surface facing the circular plate surface, the flat surface of the stators having an inner stator flat surface and an outer stator flat surface relative to a center of the circular plate surface, a sizing gap being formed by an opening between the outer stator flat surface and the circular plate surface, the outer stator flat surface extending parallel to the circular plate surface, whereby powder based granules having a size less than a width of the sizing gap pass through the opening, the inner stator flat surface being inclined relative to the circular plate with a distance between the inner stator flat surface being wider near the center of the circular plate and becoming narrower toward the outer stator flat surface, the inner stator flat surface ending at the outer stator flat surface and forming a border therebetween, and the sizing gap beginning at the border and extending between the outer stator flat surface and the circular plate, whereby powder based granules having a size greater than the width of the sizing gap accumulate above the sizing gap for disintegration and sizing, and the stators stretching over the entire circumference of the respective circular plates, at least one raw material feeding port is provided on a side wall in the vicinity of the drive shaft of the casing main body, and a cutout portion through which a raw material passes is formed on the plate surface of the respective circular plates; and disintegrating and sizing powder based granules using the powder based granules disintegrating and sizing device while directly heating and drying the powder based granules.

8. The powder based granules disintegrating and sizing method according to claim 7, wherein an upper part of the casing main body is formed into a semi-cylindrical shape concentric with a shaft core of the drive shaft, and a sheet member with a smooth surface is lined in at least a part of an inner circumferential surface of the semi-cylindrical upper part of the casing main body.

9. The powder based granules disintegrating and sizing method according to claim 8, wherein the sheet member is formed of a flexible material and an impact is applied to the sheet member from the casing main body side.

10. The powder based granules disintegrating and sizing method according to claim 7, wherein a gas supply pipe communicating with the raw material feeding port of the casing main body is provided, and a gas discharge path is connected to a discharge port that is provided in a lower part of the casing main body.

11. The powder based granules disintegrating and sizing method according to claim 10, wherein the gas supply pipe contains heated gas at portions of the device that contact the powder, and the powder is either heated directly by the heated gas and indirectly by the portions that contact the powder, so as to be disintegrated and sized.

12. The powder based granules disintegrating and sizing method according to claim 7, wherein a cutout portion is formed on a circumferential edge of the stators, and an adapter is fitted in the cutout portion.

13. The powder based granules disintegrating and sizing method according to claim 7, wherein projections are provided respectively on opposed surfaces of the respective circular plates and the stators that configure the disintegrating and sizing portion.

14. The powder based granules disintegrating and sizing method according to claim 7, wherein a disintegrating pin for roughly disintegrating the powder based granules is provided on the inclined surface of the stators and/or the plate surface of the respective circular plates.

15. The powder based granules disintegrating and sizing method according to claim 7, wherein an auxiliary pin for pressing the powder based granules toward the disintegrating and sizing portion is provided on the plate surface of the respective circular plates configuring the gap portion.

16. The powder based granules disintegrating and sizing method according to claim 7, wherein a gas supply pipe communicating with the raw material feeding port of the casing main body is provided and comprising a step of supplying hot gas from the gas supply pipe.

17. The powder based granules disintegrating and sizing method according to claim 16, wherein a gas discharge path is connected to a discharge port that is provided in a lower part of the casing main body, further comprising a step of discharging hot gas in an amount slightly larger than the amount of the hot gas supplied from the gas supply pipe from the gas discharge path.

18. A powder based granules disintegrating and sizing method which comprises:

providing a powder based granules disintegrating and sizing device, including:

a drive shaft that is inserted horizontally in a casing main body;

a plurality of circular plates that are fixedly supported at intervals by the drive shaft; and stators being arranged opposed to a circular plate surface at a circumferential edge portion of respective circular plates of the plurality of circular plates, the stators and respective circular plates of the plurality of circular plates including:

the stators having a flat surface facing the circular plate surface, the flat surface of the stators having an inner stator flat surface and an outer stator flat surface relative to a center of the circular plate, a sizing gap being formed by an opening between the outer stator flat surface and the circular plate surface, the outer stator flat surface extending parallel to the circular plate surface, whereby powder based granules having a size less than a width of the sizing gap pass through the opening, the inner stator flat surface being inclined relative to the circular plate with a distance between the inner stator flat surface being wider near the center of the circular plate and becoming narrower toward the outer stator flat surface, the inner stator flat surface ending at the outer stator flat surface and forming a border therebetween, and the sizing gap beginning at the border and extending between the outer stator flat surface and the circular plate, whereby powder based granules having a size greater than the width of the sizing gap accumulate above the sizing gap for disintegration and sizing, and the stators stretching over the entire circumference of the respective circular plates, at least one raw material feeding port is provided on a side wall in the vicinity of the drive shaft of the casing main body, and a cutout portion through which a raw material passes is formed on the plate surface of the respective circular plates; and disintegrating and sizing powder based granules using the powder based granules disintegrating and sizing device while directly cooling the powder based granules.

19. The powder based granules disintegrating and sizing method according to claim 18, wherein a gas supply pipe communicating with raw material feeding port of the casing main body is provided, and further comprising a step of supplying cold gas from the gas supply pipe.

* * * * *